US011542897B2

(12) United States Patent
Miyabe

(10) Patent No.: US 11,542,897 B2
(45) Date of Patent: Jan. 3, 2023

(54) EVAPORATED FUEL PROCESSING DEVICE

(71) Applicant: AISAN KOGYO KABUSHIKI KAISHA, Obu (JP)

(72) Inventor: Yoshikazu Miyabe, Obu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 52 days.

(21) Appl. No.: 17/336,679

(22) Filed: Jun. 2, 2021

(65) Prior Publication Data

US 2021/0388796 A1 Dec. 16, 2021

(30) Foreign Application Priority Data

Jun. 16, 2020 (JP) ..... JP2020-104036

(51) Int. Cl.
*F02M 25/08* (2006.01)

(52) U.S. Cl.
CPC ..... *F02M 25/0836* (2013.01); *F02M 25/089* (2013.01)

(58) Field of Classification Search
CPC .. F02M 25/0836; F02M 25/089; F02M 25/08; F02M 25/0854
See application file for complete search history.

(56) References Cited

U.S. PATENT DOCUMENTS

| | | | | |
|---|---|---|---|---|
| 8,640,676 | B2 | 2/2014 | Horiba et al. | |
| 9,726,120 | B2 | 8/2017 | Tagawa et al. | |
| 11,280,298 | B2 * | 3/2022 | Nakagawa | F02M 35/10222 |
| 2017/0159588 | A1 * | 6/2017 | Honjo | B01D 53/0446 |
| 2019/0285011 | A1 * | 9/2019 | Asanuma | F02M 25/089 |

FOREIGN PATENT DOCUMENTS

| | | | |
|---|---|---|---|
| JP | 2011-256778 | A | 12/2011 |
| JP | 2015-110913 | A | 6/2015 |
| JP | 2018-123699 | A | 8/2018 |

* cited by examiner

*Primary Examiner* — Xiao En Mo
(74) *Attorney, Agent, or Firm* — Shumaker, Loop & Kendrick, LLP

(57) ABSTRACT

An evaporated fuel processing device that includes a fuel tank; a vapor passage through which evaporated fuel generated from a fuel in the fuel tank flows; a closing valve configured to open and close the vapor passage; a concentration sensor configured to detect a concentration of the evaporated fuel in the vapor passage downstream of the closing valve; and a controller. When the closing valve moves toward an open side in the closed state, the controller may specify a valve-opening-start position of the closing valve based on a concentration detected by the concentration sensor, wherein the valve-opening-start position is a position where the closing valve transitions from the closed state to the opened state.

17 Claims, 12 Drawing Sheets

EVAPORATED FUEL PROCESSING DEVICE

CROSS-REFERENCE TO RELATED APPLICATION

This application claims priority to Japanese Patent Application No. 2020-104036, filed on Jun. 16, 2020, the entire contents of which are incorporated herein by reference.

TECHNICAL FIELD

The art disclosed herein relates to an evaporated fuel processing device.

BACKGROUND

Japanese Patent Application Publication No. 2011-256778 describes an evaporated fuel processing device. The evaporated fuel processing device of Japanese Patent Application Publication No. 2011-256778 includes a fuel tank, a vapor passage through which evaporated fuel generated from fuel in the fuel tank flows, a closing valve (control valve) configured to open and close the vapor passage, and a controller. The closing valve of Japanese Patent Application Publication No. 2011-256778 has a dead zone range in which a flow of the evaporated fuel is not allowed even when the opening degree is increased in an open direction from an initial position, and a communicating range in which the flow of the evaporated fuel is allowed when the opening degree is increased from the opening degree in the dead zone range. The controller of Japanese Patent Application Publication No. 2011-256778 determines whether the dead zone range and communicating range have been switched in the control valve based on an internal pressure of the fuel tank.

SUMMARY

In the evaporated fuel processing device of Japanese Patent Application Publication No. 2011-256778, whether the dead zone range and the communicating range have been switched in the control valve is determined based on the internal pressure of the fuel tank, and thus it may be difficult to specify a valve-opening-start position at which the closing valve transitions from a closed state to an opened state. For example, when the evaporated fuel is easily generated from the fuel in the fuel tank (a high volatility state in which the fuel is being highly volatile), a generation rate of the evaporated fuel is relatively high and a rise rate of the internal pressure in the fuel tank is relatively high, and this makes it difficult to specify the valve-opening-start position of the closing valve. More specifically, for example in the evaporated fuel processing device of Japanese Patent Application Publication No. 2011-256778, it may be determined that the closing valve has switched from the dead zone range to the communicating range when the internal pressure of the fuel tank starts to decrease or becomes constant. In this configuration, when the rise rate of the internal pressure in the fuel tank is relatively high (high volatility state), the internal pressure in the fuel tank could keep increasing even though the closing valve has switched from the closed state to the opened state. It is thus difficult to accurately specify the valve-opening-start position of the closing valve based on the internal pressure of the fuel tank. In view of this, the disclosure herein provides a technique that enables accurate specification for a valve-opening-start position of a closing valve.

An evaporated fuel processing device disclosed herein may comprise a fuel tank; a vapor passage through which evaporated fuel generated from fuel in the fuel tank flows; a closing valve configured to open and close the vapor passage; a concentration sensor configured to detect a concentration of the evaporated fuel in the vapor passage downstream of the closing valve; and a controller. When the closing valve is in an opened state, the evaporated fuel in the vapor passage flows through the closing valve. When the closing valve is in a closed state, the evaporated fuel in the vapor passage does not flow through the closing valve. When the closing valve moves toward an open side in the closed state, the controller may specify a valve-opening-start position of the closing valve based on the concentration detected by the concentration sensor. The valve-opening-start position is a position where the closing valve transitions from the closed state to the opened state.

DETAILED DESCRIPTION

Figure 1:
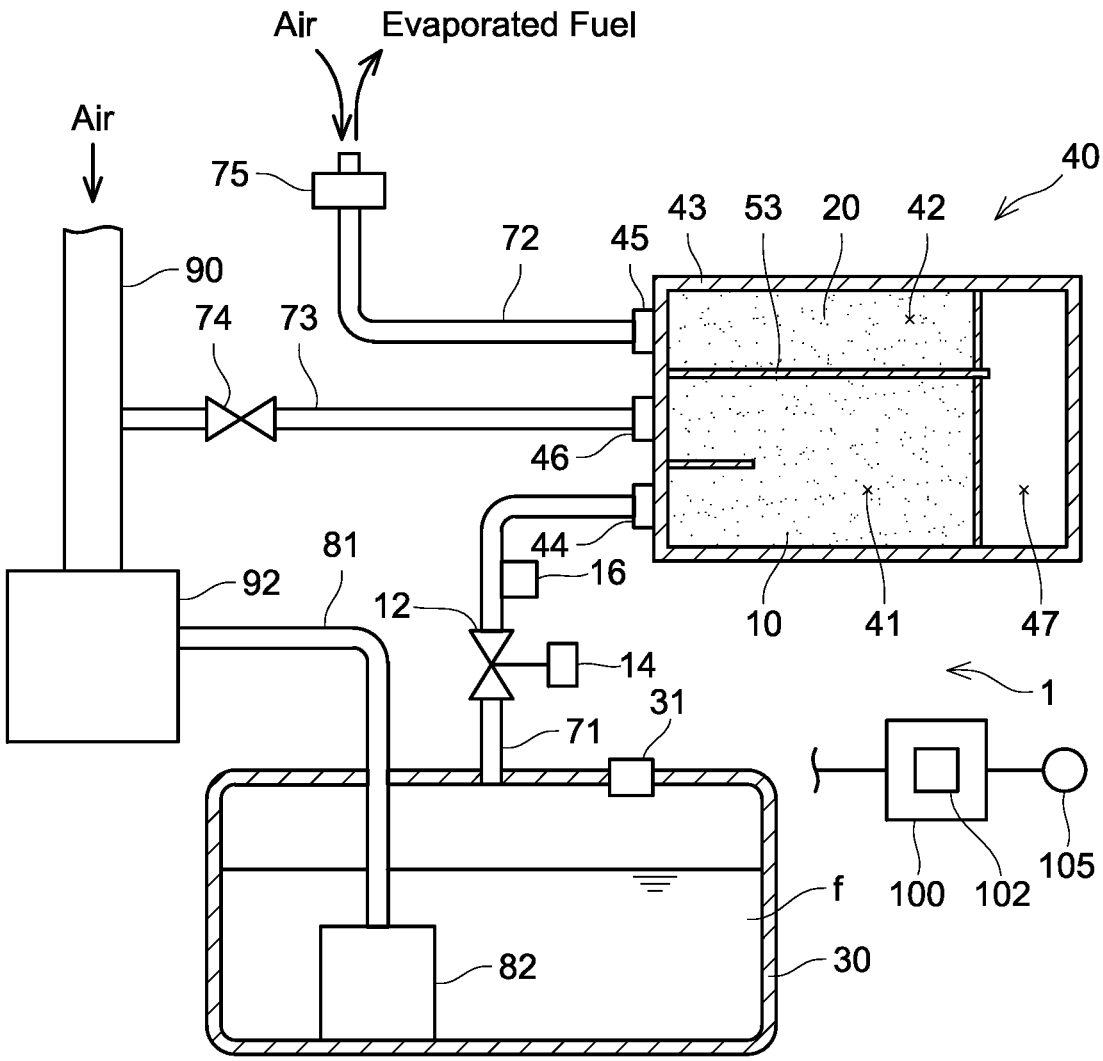
FIG. 1 schematically shows an evaporated fuel processing device according to a first embodiment.

Representative, non-limiting examples of the present disclosure will now be described in further detail with reference to the attached drawings. This detailed description is merely intended to teach a person of skill in the art further details for practicing aspects of the present teachings and is not intended to limit the scope of the present disclosure. Furthermore, each of the additional features and teachings disclosed below may be utilized separately or in conjunction with other features and teachings to provide improved evaporated fuel processing devices, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

An evaporated fuel processing device disclosed herein may comprise a fuel tank; a vapor passage through which evaporated fuel generated from fuel in the fuel tank flows; a closing valve configured to open and close the vapor passage; a concentration sensor configured to detect a concentration of the evaporated fuel in the vapor passage downstream of the closing valve; and a controller. When the closing valve is in an opened state, the evaporated fuel in the vapor passage flows through the closing valve. When the closing valve is in a closed state, the evaporated fuel in the vapor passage does not flow through the closing valve. When the closing valve moves toward an open side in the closed state, the controller may specify a valve-opening-start position of the closing valve based on the concentration detected by the concentration sensor. The valve-opening-start position is a position where the closing valve transitions from the closed state to the opened state.

In the above configuration, the evaporated fuel in the vapor passage flows through the closing valve when the closing valve transitions from the closed state to the opened state (i.e., when the closing valve reaches the valve-opening-start position). When the transition happens, the concentration of the evaporated fuel increases downstream of the closing valve, and thus the valve-opening-start position of the closing valve can be specified based thereon. In this configuration, the valve-opening-start position of the closing valve can be specified based on the concentration detected by the concentration sensor without being affected by a pressure in the fuel tank. Therefore, the valve-opening-start position of the closing valve, which is configured to open and close the vapor passage, can be accurately specified. For example, when the evaporated fuel is easily generated from the fuel in the fuel tank (a high-volatility state in which the fuel is being highly volatile), a generation rate of the evaporated fuel is relatively high and a rise rate of an internal pressure in the fuel tank is relatively high, and thus the internal pressure of the fuel tank may increase even though the closing valve has transitioned from the closed state to the opened state. However, in the above-described configuration, the valve-opening-start position of the closing valve is specified based on the concentration detected by the concentration sensor, and thus the valve-opening-start position of the closing valve can be specified without being affected by the pressure in the fuel tank. Therefore, the valve-opening-start position of the closing valve can be accurately specified. Even when the evaporated fuel is easily generated from the fuel in the fuel tank (high volatility state), the valve-opening-start position of the closing valve can be accurately specified.

The controller may specify, as the valve-opening-start position, a position of the closing valve when the concentration detected by the concentration sensor becomes equal to or greater than a predetermined reference concentration.

With this configuration, the valve-opening-start position can be accurately specified by specifying the valve-opening-start position of the closing valve based on the reference concentration.

The evaporated fuel processing device may further comprise a pressure sensor configured to detect a pressure in the fuel tank. When the closing valve moves toward the open side in the closed state in a state where the pressure in the fuel tank detected by the pressure sensor is in a predetermined state, the controller may specify the valve-opening-start position based on the concentration detected by the concentration sensor.

The technique that specifies the valve-opening-start position of the closing valve based on the concentration detected by the concentration sensor enables the valve-opening-start position of the closing valve to be specified without being affected by the pressure in the fuel tank. Using this technique in accordance with a state of the pressure in the fuel tank is especially effective. For example, the technique is especially effective when the evaporated fuel is easily generated from the fuel in the fuel tank (high volatility state) or when the pressure in the fuel tank is high (high pressure state). With the above-described configuration, the valve-opening-start position of the closing valve can be specified without being affected by the state of the pressure in the fuel tank even under the high volatility state or the high pressure state, and thus the valve-opening-start position of the closing valve can be accurately specified.

When the closing valve moves toward the open side in the closed state in a state where a rise per unit time in the pressure detected by the pressure sensor is equal to or greater than a predetermined reference rise, the controller may specify the valve-opening-start position based on the concentration detected by the concentration sensor.

When the rise per unit time in the pressure detected by the pressure sensor is equal to or greater than the reference rise, it is conceivable that the evaporated fuel is easily generated from the fuel in the fuel tank (the fuel is being highly volatile). With the above-described configuration, the valve-opening-start position of the closing valve can be specified without being affected by the pressure in the fuel tank even under the high volatility state, and thus the valve-opening-start position of the closing valve can be accurately specified. Further, the evaporated fuel easily flows into the vapor passage under the high volatility state, and thus the concentration detected by the concentration sensor tends to increase. Therefore, the configuration in which the valve-opening-start position of the closing valve is specified based on the concentration detected by the concentration sensor is especially effective.

When the closing valve moves toward the open side in the closed state in a state where a rise per unit time in the pressure detected by the pressure sensor is less than a predetermined reference rise, the controller may specify the valve-opening-start position based on the pressure detected by the pressure sensor.

When the rise per unit time in the pressure detected by the pressure sensor is less than the reference rise, it is not conceivable that it is under the high volatility state. That is, it is conceivable that it is under a low volatility state in which the generation rate of the evaporated fuel is relatively low and the rise rate of the pressure in the fuel tank is relatively low. In this case, the valve-opening-start position of the closing valve may be specified based on the pressure detected by the pressure sensor. With the above-described configuration, the sensors used to specify the valve-opening-start position of the closing valve can be switched depending on the state of the pressure in the fuel tank.

The controller may specify, as the valve-opening-start position, a position of the closing valve when a decrease in the pressure detected by the pressure sensor becomes equal to or greater than a predetermined reference decrease.

By specifying the valve-opening-start position of the closing valve based on the reference decrease, the valve-opening-start position can be accurately specified.

In a case where the concentration detected by the concentration sensor does not become equal to or greater than the predetermined reference concentration when the controller specifies the valve-opening-start position based on the pressure detected by the pressure sensor, the controller may determine that the concentration sensor is operating abnormally.

When the controller specifies the valve-opening-start position of the closing valve is when the closing valve transitions to the opened state, and thus the concentration detected by the concentration sensor is supposed to become equal to or greater than the reference concentration if the concentration sensor is operating normally. As such, in a case where the concentration detected by the concentration sensor does not become equal to or greater than the reference concentration, it can be determined that some sort of abnormality is occurring in the concentration sensor. With the above configuration, the valve-opening-start position of the closing valve can be specified based on the pressure detected by the pressure sensor, and further whether abnormality is occurring in the concentration sensor can be determined.

When the closing valve moves toward the open side in the closed state in a state where the rise per unit time in the pressure detected by the pressure sensor is less than the predetermined reference rise, the controller may specify the valve-opening-start position based on the concentration detected by the concentration sensor. When a decrease of the pressure detected by the pressure sensor does not become equal to or greater than a predetermined reference decrease even though the controller specifies the valve-opening-start position based on the concentration, the controller may determine that the pressure sensor is operating abnormally.

When the controller specifies the valve-opening-start position of the closing valve in the state where the rise per unit time in the pressure detected by the pressure sensor is less than the reference rise, the decrease in the pressure detected by the pressure sensor is supposed to become equal to or greater than the reference decrease if the pressure sensor is operating normally. As such, the decrease in the pressure detected by the pressure sensor not becoming equal to or greater than the reference decrease means that the decrease in the pressure detected by the pressure sensor is insufficient even though the pressure in the fuel tank is decreasing. Thus, in this case, it can be determined that some sort of abnormality is occurring in the pressure sensor. With the above configuration, the valve-opening-start position of the closing valve can be specified based on the concentration detected by the concentration sensor, and further whether abnormality is occurring in the pressure sensor can be determined.

The evaporated fuel processing device may further comprise a stepping motor configured to actuate the closing valve. The controller may specify the valve-opening-start position based on a number of steps by which the stepping motor has been rotated.

With this configuration, the valve-opening-start position can be more accurately specified by specifying the valve-opening-start position of the closing valve based on the number of steps by which the stepping motor has been rotated.

The controller may specify the valve-opening-start position based on the number of steps by which the stepping motor has been rotated from a state where the stepping motor is at an initial value until the closing valve transitions to the opened state.

With this configuration, the reference is clear since the valve-opening-start position of the closing valve is specified based on the number of steps from the initial value, and thus the valve-opening-start position can be more accurately specified.

The controller may control an opening degree of the closing valve based on the specified valve-opening-start position.

With this configuration, the opening degree of the closing valve can be controlled based on the specified valve-opening-start position. Thus, the opening degree of the closing valve can be controlled accurately.

The evaporated fuel processing device may further comprise a canister including an adsorbent on which the evaporated fuel having flowed through the vapor passage is adsorbed. The concentration sensor may detect the concentration of the evaporated fuel in the vapor passage downstream of the closing valve and upstream of the canister.

With this configuration, the concentration of the evaporated fuel can be detected before the evaporated fuel is adsorbed in the canister. Thus, the concentration of the evaporated fuel that has flowed through the closing valve can be accurately detected. Therefore, the valve-opening-start position of the closing valve can be accurately specified.

The evaporated fuel processing device may further comprise a purge passage through which the evaporated fuel desorbed from the canister flows; and a purge valve configured to open and close the purge passage. The concentration sensor may be configured to detect the concentration of the evaporated fuel in the vapor passage downstream of the closing valve and a concentration of the evaporated fuel in the purge passage upstream of the purge valve.

With this configuration, the concentration of the evaporated fuel to be adsorbed in the canister and the concentration of the evaporated fuel desorbed from the canister can be detected. Depending on the situation, either of the concentrations can selectively detected. For example, the concentration of the evaporated fuel in the vapor passage can be detected during an adsorbing process. Further, the concentration of the evaporated fuel in the purge passage can be detected during a desorbing process.

The evaporated fuel processing device may further comprise an overlapping passage where a portion of the vapor passage downstream of the closing valve overlaps a portion of the purge passage upstream of the purge valve. The concentration sensor may be configured to detect a concentration of the evaporated fuel in the overlapping passage.

In this configuration, the use of the overlapping passage enables detection of two concentrations (the concentration of the evaporated fuel before the evaporated fuel is adsorbed in the canister and the concentration of the evaporated fuel desorbed from the canister) by one passage.

The evaporated fuel processing device may be configured to execute an adsorbing process in which the evaporated fuel having flowed through the vapor passage is adsorbed in the canister and a desorbing process in which the evaporated fuel adsorbed in the canister is desorbed from the canister. The controller may control an opening degree of the purge valve in the desorbing process based on the concentration detected by the concentration sensor.

In the configuration in which the concentration of the evaporated fuel in the purge passage is detected using the concentration sensor, the concentration of the evaporated fuel can be directly detected by the concentration sensor in the desorbing process. Thus, the concentration of the evaporated fuel can be specified at an early stage. As a result, the opening degree of the purge valve can be controlled at an early stage based on the concentration detected by the concentration sensor in the desorbing process. Thus, the opening degree of the purge valve can be increased at an early stage, and a purge amount can be increased at an early stage.

In a configuration according to a comparative example that does not include the concentration sensor configured to detect the concentration of the evaporated fuel in the purge passage, the concentration of the evaporated fuel cannot be directly detected by the concentration sensor in the desorbing process. Thus, in the comparative example, the controller has to estimate the concentration of the evaporated fuel based on an index different from the concentration detected by the concentration sensor (e.g., the pressure in the fuel tank, an intake amount of an engine, etc.). As a result, in the comparative example, it is not possible to specify the concentration of the evaporated fuel at an early stage. Thus, the opening degree of the purge valve cannot be increased at an early stage, and the purge amount cannot be increased at an early stage.

The vapor passage may comprise a first passage and a second passage. The first passage and the second passage branch from the vapor passage downstream of the closing valve and are arranged in parallel to each other. The evaporated fuel processing device may further comprise a switching valve configured to switch between a first state in which the evaporated fuel flows through the first passage and into the canister and a second state in which the evaporated fuel flows through the second passage and into the canister. The concentration sensor may be configured to detect a concentration of the evaporated fuel in the first passage. The controller may switch the switching valve to the second state in the desorbing process.

This configuration enables the concentration sensor not to detect the concentration of the evaporated fuel that was generated from the fuel in the fuel tank and has not been adsorbed yet in the canister in the desorbing process. The switching valve can be switched in the desorbing process such that the concentration of the evaporated fuel that has been desorbed from the canister can be detected by the concentration sensor.

When the closing valve moves toward the open side in the closed state in a state where a pressure in the fuel tank is equal to or greater than a detection limit pressure of the pressure sensor, the controller may specify the valve-opening-start position based on the concentration detected by the concentration sensor.

With this configuration, the valve-opening-start position of the closing valve can be accurately specified even when the pressure in the fuel tank is excessively high.

First Embodiment (Configuration of Evaporated Fuel Processing Device 1)

An evaporated fuel processing device 1 according to a first embodiment will be described with reference to the drawings. FIG. 1 schematically shows the evaporated fuel processing device 1 according to the first embodiment. As shown in FIG. 1, the evaporated fuel processing device 1 includes a fuel tank 30, a canister 40, and a controller 100. Further, the evaporated fuel processing device 1 also includes a vapor passage 71, an open air passage 72, and a purge passage 73. The evaporated fuel processing device 1 shown in FIG. 1 is mounted in a vehicle such as a gasoline-fueled vehicle or a hybrid vehicle.

The fuel tank 30 is configured to store fuel f such as gasoline. The fuel f is poured into the fuel tank 30 from an inlet (not shown). A fuel pump 82 is disposed in the fuel tank 30. A fuel passage 81 is connected to the fuel pump 82. The fuel pump 82 is configured to discharge the fuel fin the fuel tank 30 to the fuel passage 81. The fuel f discharged into the fuel passage 81 is supplied to an engine 92 of the vehicle through the fuel passage 81.

The fuel f in the fuel tank 30 may evaporate within the fuel tank 30. For example, the fuel f may evaporate while the vehicle in which the evaporated fuel processing device 1 is mounted is traveling. The fuel f may also evaporate during when the vehicle in which the evaporated fuel processing device 1 is mounted is parked. Evaporated fuel is generated in the fuel tank 30 by the fuel f evaporating in the fuel tank 30.

A pressure sensor 31 is disposed at the fuel tank 30. The pressure sensor 31 is configured to detect a pressure in the fuel tank 30. When the pressure sensor 31 detects the pressure in the fuel tank 30, information on the detected pressure is sent to the controller 100. The controller 100 obtains the information on the detected pressure. The pressure in the fuel tank 30 may be increased by the evaporated fuel being generated in the fuel tank 30.

An upstream end of the vapor passage 71 is connected to the fuel tank 30. Gas that contains the evaporated fuel generated in the fuel tank 30 flows into the vapor passage 71. A downstream end of the vapor passage 71 is connected to the canister 40. The gas having flowed through the vapor passage 71 flows into the canister 40. The vapor passage 71 guides the gas containing the evaporated fuel generated in the fuel tank 30 from the fuel tank 30 to the canister 40. In the disclosure herein, description is made considering a side where the fuel tank 30 is as an upstream side and the opposite side from the fuel tank 30 (open air side) as a downstream side.

A closing valve 12 is disposed on the vapor passage 71. The closing valve 12 is configured to open and close the vapor passage 71. When the closing valve 12 transitions to an opened state, the gas containing the evaporated fuel in the vapor passage 71 flows through the closing valve 12. The gas flows from the upstream side to the downstream side of the vapor passage 71. When the closing valve 12 transitions to a closed state, the flow of the gas containing the evaporated fuel is cut off in the vapor passage 71. The closing valve 12 may, for example, be a globe valve, a ball valve, a gate valve, a butterfly valve, or a diaphragm valve. The closing valve 12 is actuated by a stepping motor 14.

The stepping motor 14 is attached to the closing valve 12 and is configured to actuate the closing valve 12. In a variant, the stepping motor 14 may be incorporated in the closing valve 12. The stepping motor 14 causes the closing valve 12 to move to an open side or to a closing side. For example, as the number of steps by which the stepping motor 14 has been rotated (which will be termed "the number of steps of the stepping motor 14") increases, the closing valve 12 moves toward the open side. On the other hand, as the number of steps of the stepping motor 14 decreases, the closing valve 12 moves to the closing side. The stepping motor 14 is configured such that its rotation angle changes as the number of steps changes based on pulse signals. The rotation angle per one step of the stepping motor 14 may, for example, be 0.72 degrees. The opening degree of the closing valve 12 corresponds to the number of steps of the stepping motor 14.

A concentration sensor 16 is further disposed on the vapor passage 71. The concentration sensor 16 is arranged between the closing valve 12 and the canister 40. In a variant, the concentration sensor 16 may be integral with the closing valve 12. The concentration sensor 16 is configured to detect a concentration of the evaporated fuel contained in the gas flowing through the vapor passage 71. The concentration sensor 16 detects the concentration of the evaporated fuel contained in the gas flowing through the vapor passage 71 downstream of the closing valve 12 and upstream of the canister 40. When the concentration sensor 16 detects the concentration of the evaporated fuel, information on the detected concentration is sent to the controller 100. The controller 100 obtains the information on the detected concentration. The concentration of the evaporated fuel in the vapor passage 71 downstream of the closing valve 12 may be increased by the closing valve 12 transitioning to the opened state.

Figure 2:
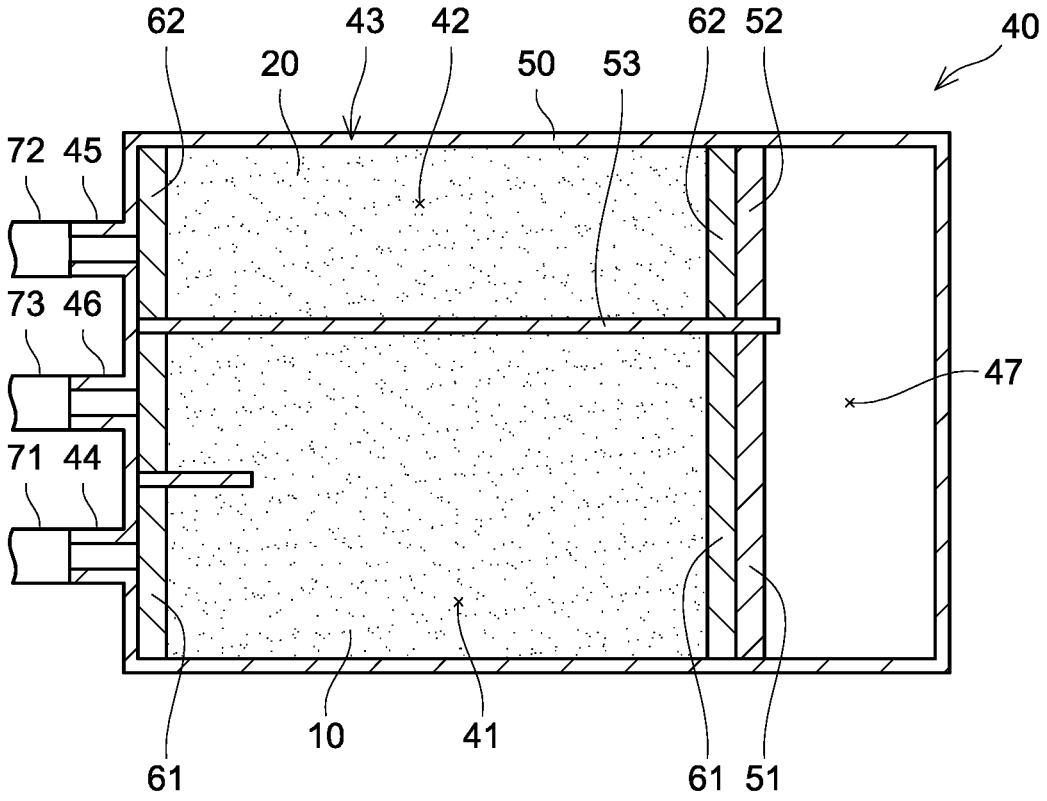
FIG. 2 shows a cross-sectional view of a canister according to the first embodiment.

Next, the canister 40 will be described. FIG. 2 is a cross-sectional view of the canister 40. As shown in FIG. 2, the canister 40 includes a casing 43 and a plurality of ports (a tank port 44, an open air port 45, and a purge port 46). The casing 43 and the plurality of ports (the tank port 44, the open air port 45, and the purge port 46) may, for example, be constituted of resin. The casing 43 is integral with the plurality of ports (the tank port 44, the open air port 45, and the purge port 46).

The casing 43 includes a casing body 50 and a partitioning wall 53. The casing body 50 is integral with the partitioning wall 53. The partitioning wall 53 is disposed in the casing body 50 and partitions a space inside the casing body 50. A first chamber 41 and a second chamber 42 are defined within the casing body 50 by the space in the casing body 50 being partitioned by the partitioning wall 53. A first adsorbent 10 is housed in the first chamber 41. A second adsorbent 20 is housed in the second chamber 42. The first adsorbent 10 and the second adsorbent 20 will be described later.

The first chamber 41 is located upstream of (on the fuel tank 30 side relative to) the second chamber 42 (see FIG. 1). A first porous plate 51 and a pair of first filters 61 are disposed in the first chamber 41. The first porous plate 51 is arranged at a downstream end of the first chamber 41. A plurality of pores (not shown) is formed in the first porous plate 51. Gas flowing in the first chamber 41 flows through the plurality of pores formed in the first porous plate 51. The first filters 61 are arranged at upstream and downstream ends of the first chamber 41, respectively. The first adsorbent 10 is interposed between the pair of first filters 61. The first filters 61 are configured to remove foreign matters contained in the gas flowing in the first chamber 41.

The second chamber 42 is located downstream of (on the opposite side from the fuel tank 30 (open air side) relative to) the first chamber 41 (see FIG. 1). A second porous plate 52 and a pair of second filters 62 are disposed in the second chamber 42. The second porous plate 52 is arranged at an upstream end of the second chamber 42. A plurality of pores (not shown) is formed in the second porous plate 52. Gas flowing in the second chamber 42 flows through the plurality of pores formed in the second porous plate 52. The second filters 62 are arranged at upstream and downstream ends of the second chamber 42. The second adsorbent 20 is interposed between the pair of second filters 62. The second filters 62 are configured to remove foreign matters contained in the gas flowing in the second chamber 42.

An intermediate chamber 47 is defined between the first chamber 41 and the second chamber 42. The intermediate chamber 47 is defined in the casing body 50 by the space in the casing body 50 being partitioned by the first porous plate 51 and the second porous plate 52.

The tank port 44 of the canister 40 is located adjacent to the first chamber 41 of the casing 43. The tank port 44 is in communication with the first chamber 41. The downstream end of the vapor passage 71 is connected to the tank port 44. The vapor passage 71 is in communication with the first chamber 41 through the tank port 44. The gas having flowed through the vapor passage 71 flows into the first chamber 41 through the tank port 44.

The open air port 45 of the canister 40 is located adjacent to the second chamber 42 of the casing 43. The open air port 45 is in communication with the second chamber 42. An upstream end of the open air passage 72 is connected to the open air port 45. The second chamber 42 is in communication with the open air passage 72 through the open air port 45. The gas having flowed through the second chamber 42 flows into the open air passage 72 through the open air port 45.

A downstream end of the open air passage 72 is open to open air (see FIG. 1). The gas having flowed through the open air passage 72 is discharged to the open air. When the evaporated fuel is desorbed (which will be described later), air from the open air flows into the open air passage 72 from the downstream end of the open air passage 72. The air having flowed into the open air passage 72 flows through the open air passage 72 into the second chamber 42 of the casing 43 through the open air port 45. An air filter 75 is disposed on the open air passage 72. The air filter 75 is configured to remove foreign matters contained in the air flowing into the open air passage 72.

The purge port 46 of the canister 40 is located adjacent to the first chamber 41 of the casing 43. The purge port 46 is in communication with the first chamber 41. An upstream end of the purge passage 73 is connected to the purge port 46. The first chamber 41 is in communication with the purge passage 73 through the purge port 46. The gas having flowed through the first chamber 41 flows into the purge passage 73 through the purge port 46.

A downstream end of the purge passage 73 is connected to an intake passage 90. The gas having flowed through the purge passage 73 flows into the intake passage 90. A purge valve 74 is disposed on the purge passage 73. The purge valve 74 is configured to open and close the purge passage 73. When the purge valve 74 is in an opened state, gas flows through the purge passage 73. A pump (not shown) may be disposed on the purge passage 73.

An upstream end of the intake passage 90 is open to the open air. Air from the open air flows into the intake passage 90. A downstream end of the intake passage 90 is connected to the engine 92 of the vehicle. The air having flowed through the intake passage 90 flows into the engine 92.

Next, the first adsorbent 10 and the second adsorbent 20 will be described. The first adsorbent 10 is set in the first chamber 41. The first adsorbent 10 is constituted of active carbon, for example. The active carbon constituting the first adsorbent 10 has an ability to adsorb the evaporated fuel. While the gas containing the evaporated fuel is flowing through the first adsorbent 10, a part of the evaporated fuel in the gas is adsorbed by the active carbon. Further, while air is flowing through the first adsorbent 10, the evaporated fuel adsorbed on the active carbon is desorbed into the air from the active carbon (i.e., the evaporated fuel is purged). The active carbon may, for example, be in the form of pellets or monolith. Granulated carbon or crushed carbon may be used as the active carbon, for example. Coal-based or wood-based active carbon may be used as the active carbon, for example. In a variant, the first adsorbent 10 may be constituted of a porous metal complex.

The second adsorbent 20 is set in the second chamber 42. The second adsorbent 20 is constituted of a porous metal complex. The porous metal complex constituting the second adsorbent 20 has an ability to adsorb the evaporated fuel. While the gas containing the evaporated fuel is flowing through the second adsorbent 20, a part of the evaporated fuel in the gas is adsorbed by the porous metal complex. Further, while air is flowing through the second adsorbent 20, the evaporated fuel adsorbed on the porous metal complex is desorbed into the air from the porous metal complex (i.e., the evaporated fuel is purged). For example, the porous metal complex may be in the form of pellets or monolith, or may be in the form of a thin film in which the porous metal complex is applied on a substrate with air permeability. In a variant, the second adsorbent 20 may be constituted of active carbon.

The controller 100 of the evaporated fuel processing device 1 includes, for example, a CPU (not shown) and a memory 102 (such as ROM, RAM, etc.) and is configured to execute predetermined control and processes based on a predetermined program. The controller 100 may also be called an ECU (engine control unit). The control and processes executed by the controller 100 will be described later. An ignition switch 105 (hereinbelow termed "IG switch") for turning the engine 92 of the vehicle on and off is connected to the controller 100.

(Operation of Evaporated Fuel Processing Device 1)

(Adsorbing Process)

Next, operation of the evaporated fuel processing device 1 will be described. Firstly, an adsorbing process in which the evaporated fuel is adsorbed in the canister 40 will be described. Here, how the evaporated fuel processing device 1 operates when the closing valve 12 on the vapor passage 71 is in the opened state will be described. In the evaporated fuel processing device 1, the gas containing the evaporated fuel generated from the fuel f in the fuel tank 30 flows from the fuel tank 30 into the vapor passage 71. The gas containing the evaporated fuel having flowed into the vapor passage 71 flows through the closing valve 12 in the opened state and then flows to a downstream portion of the vapor passage 71. After this, the gas containing the evaporated fuel having flowed through the vapor passage 71 flows into the first chamber 41 in the canister body 50 through the tank port 44 of the canister 40. While the gas containing the evaporated fuel is flowing through the vapor passage 71, the concentration of the evaporated fuel is detected by the concentration sensor 16 on the vapor passage 71. When the closing valve 12 is in the closed state, the flow of the gas is cut off in the vapor passage 71.

The gas containing the evaporated fuel having flowed from the vapor passage 71 into the first chamber 41 flows through the first adsorbent 10 housed in the first chamber 41 into the intermediate chamber 47. While the gas containing the evaporated fuel is flowing through the first adsorbent 10, the first adsorbent 10 adsorbs a part of the evaporated fuel in the gas. The evaporated fuel is adsorbed on the active carbon constituting the first adsorbent 10. The evaporated fuel that was not adsorbed by the active carbon flows from the first chamber 41 into the intermediate chamber 47.

The gas containing the evaporated fuel having flowed into the intermediate chamber 47 through the first adsorbent 10 flows into the second chamber 42. The gas containing the evaporated fuel having flowed into the second chamber 42 flows through the second adsorbent 20 housed in the second chamber 42 into the open air passage 72 through the open air port 45. While the gas containing the evaporated fuel is flowing through the second adsorbent 20, the second adsorbent 20 adsorbs a part of the evaporated fuel in the gas. The evaporated fuel is adsorbed on the porous metal complex constituting the second adsorbent 20. The evaporated fuel that was not adsorbed by the porous metal complex flows from the second chamber 42 into the open air passage 72.

The gas containing the evaporated fuel having flowed into the open air passage 72 through the second adsorbent 20 is discharged into the open air. The evaporated fuel that was not adsorbed by the first adsorbent 10 (e.g., active carbon) nor the second adsorbent 20 (e.g., porous metal complex) is discharged to the open air.

(Desorbing Process)

Next, a desorbing process in which the evaporated fuel is desorbed from the canister 40 will be described. In the above evaporated fuel processing device 1, gas can flow through the purge passage 73 when the purge valve 74 on the purge passage 73 is in the opened state. Further, when the engine 92 of the vehicle in which the evaporated fuel processing device 1 is mounted starts to operate, air flowing in the intake passage 90 is suctioned into the engine 92 and a negative pressure is applied in the intake passage 90. Thereby, the gas flows from the purge passage 73 into the intake passage 90. Along with this, air from the open air flows into the open air passage 72. The air having flowed into the open air passage 72 flows into the second chamber 42 in the casing body 50 through the open air port 45 of the canister 40. The air having flowed through the second chamber 42 flows through the second adsorbent 20 housed in the second chamber 42 into the intermediate chamber 47. While the air is flowing through the second adsorbent 20, the evaporated fuel adsorbed on the second adsorbent 20 is desorbed from the second adsorbent 20 into the air. That is, the evaporated fuel is purged. The air containing the purged evaporated fuel flows from the second chamber 42 into the intermediate chamber 47.

The air containing the purged evaporated fuel having flowed into the intermediate chamber 47 flows into the first chamber 41. The air having flowed into the first chamber 41 flows through the first adsorbent 10 housed in the first chamber 41 into the purge passage 73 through the purge port 46. While the air is flowing through the first adsorbent 10, the evaporated fuel adsorbed on the first adsorbent 10 is desorbed from the first adsorbent 10 to the air. That is, the evaporated fuel is purged. The air containing the purged evaporated fuel flows from the first chamber 41 into the purge passage 73.

The air containing the evaporated fuel having flowed into the purge passage 73 flows through the purge passage 73 into the intake passage 90. The air containing the evaporated fuel having flowed into the intake passage 90 is suctioned into the engine 92.

Figure 3:
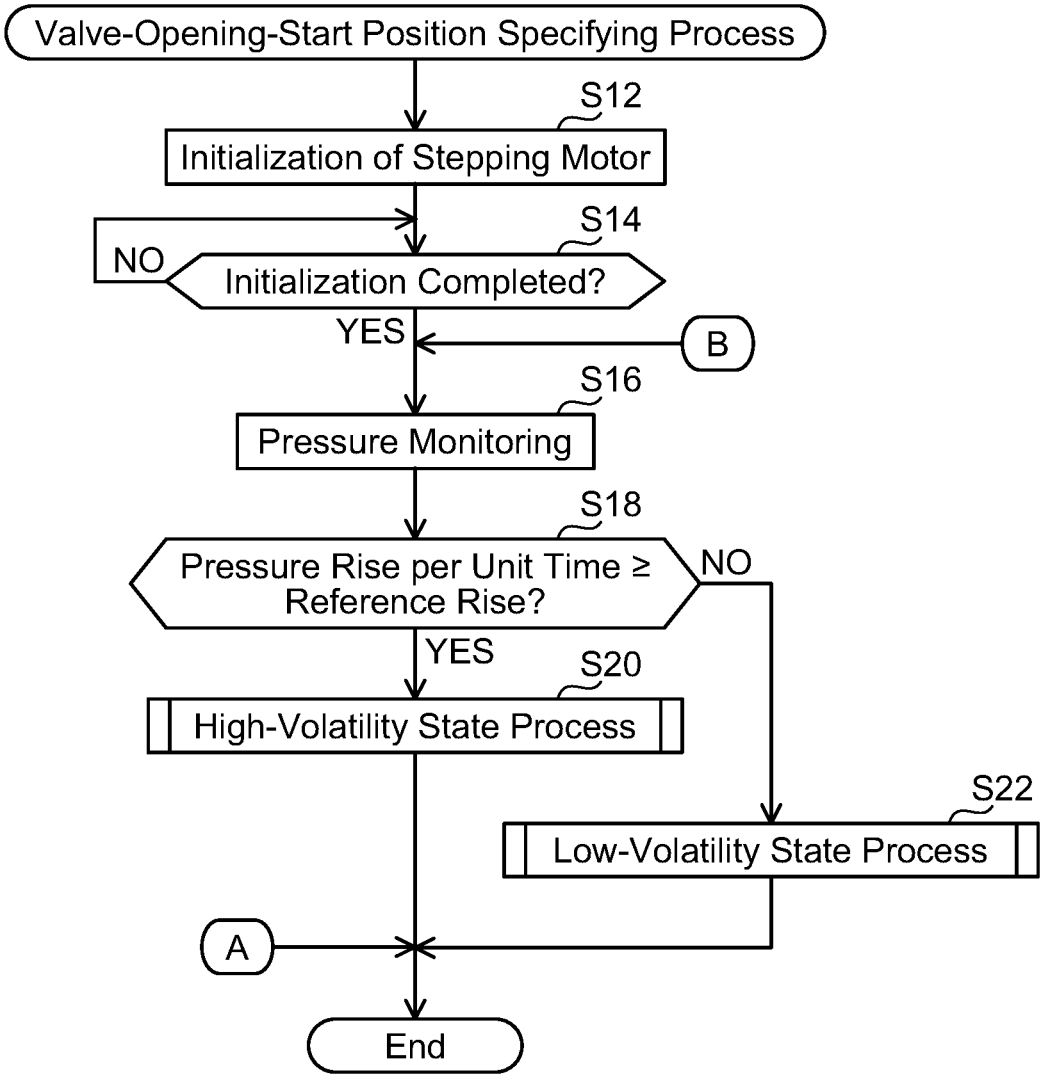
FIG. 3 is a flowchart of a valve-opening-start position specifying process according to the first embodiment.

(Valve-Opening-Start Position Specifying Process; FIG. 3)

Next, other processes executed by the evaporated fuel processing device 1 will be described. Firstly, a valve-opening-start position specifying process will be described. FIG. 3 is a flowchart of the valve-opening-start position specifying process. The valve-opening-start position specifying process is started when the IG switch 105 of the vehicle in which the evaporated fuel processing device 1 is mounted is turned on, for example. The IG switch 105 is turned on when a start button of the engine 92 is pressed by a driver of the vehicle, for example.

As shown in FIG. 3, in S12 of the valve-opening-start position specifying process, the controller 100 executes initialization of the stepping motor 14. The initialization of the stepping motor 14 is a process of setting an initial value of the stepping motor 14 by decreasing the number of steps of the stepping motor 14 (i.e., by rotating the stepping motor 14 in a negative direction). As a result of the initialization of the stepping motor 14, the initial value of the stepping motor 14 is set. Further, as a result of the initialization of the stepping motor 14, the closing valve 12 moves to the closing side and transitions to the closed state.

In S14, the controller 100 determines whether the initialization of the stepping motor 14 is completed. Whether the initialization is completed or not is determined, for example, based on whether the number of steps of the stepping motor 14 has been sufficiently decreased to bring the closing valve 12 into the closed state. If the initialization is completed, the controller 100 determines YES in S14 and proceeds to S16. If not, the controller 100 determines NO and waits.

In S16, the controller 100 monitors a pressure detected by the pressure sensor 31 disposed at the fuel tank 30 of the vehicle (i.e., a pressure in the fuel tank 30). The controller 100 monitors the detected pressure by the pressure sensor 31 over a predetermined period (e.g., 30 seconds). In S18, the controller 100 determines whether a rise (kPa/sec) per unit time (e.g., 1 second) in the detected pressure by the pressure sensor 31 is no less than a predetermined reference rise. If the rise per unit time in the detected pressure is equal to or greater than the reference rise, the controller 100 determines YES in S18 and proceeds to S20. If not, the controller 100 determines NO and proceeds to S22.

When the rise per unit time in the detected pressure by the pressure sensor 31 is equal to or greater than the reference rise, the rise rate of the pressure in the fuel tank 30 is relatively high. In this state, a generation amount per unit time of the evaporated fuel generated from the fuel in the fuel tank 30 is relatively large. That is, the fuel in the fuel tank 30 can relatively easily evaporate. This state may, for example, be termed a high-volatility state.

On the other hand, when the rise per unit time in the detected pressure by the pressure sensor 31 is less than the reference rise, the rise rate of the pressure in the fuel tank 30 is relatively low. In this state, the generation amount per unit time of the evaporated fuel generated from the fuel in the fuel tank 30 is relatively small. That is, the fuel in the fuel tank 30 is relatively hard to evaporate. This state may, for example, be termed a low-volatility state.

As shown in FIG. 3, in S20 following YES in S18, the controller 100 executes a high-volatility state process. That is, when the fuel tank 30 is under the high-volatility state, the high-volatility state process is executed. On the other hand, in S22 following NO in S18, the controller 100 executes a low-volatility state process. That is, when the fuel tank 30 is under the low-volatility state, the low-volatility state process is executed.

Figure 4:
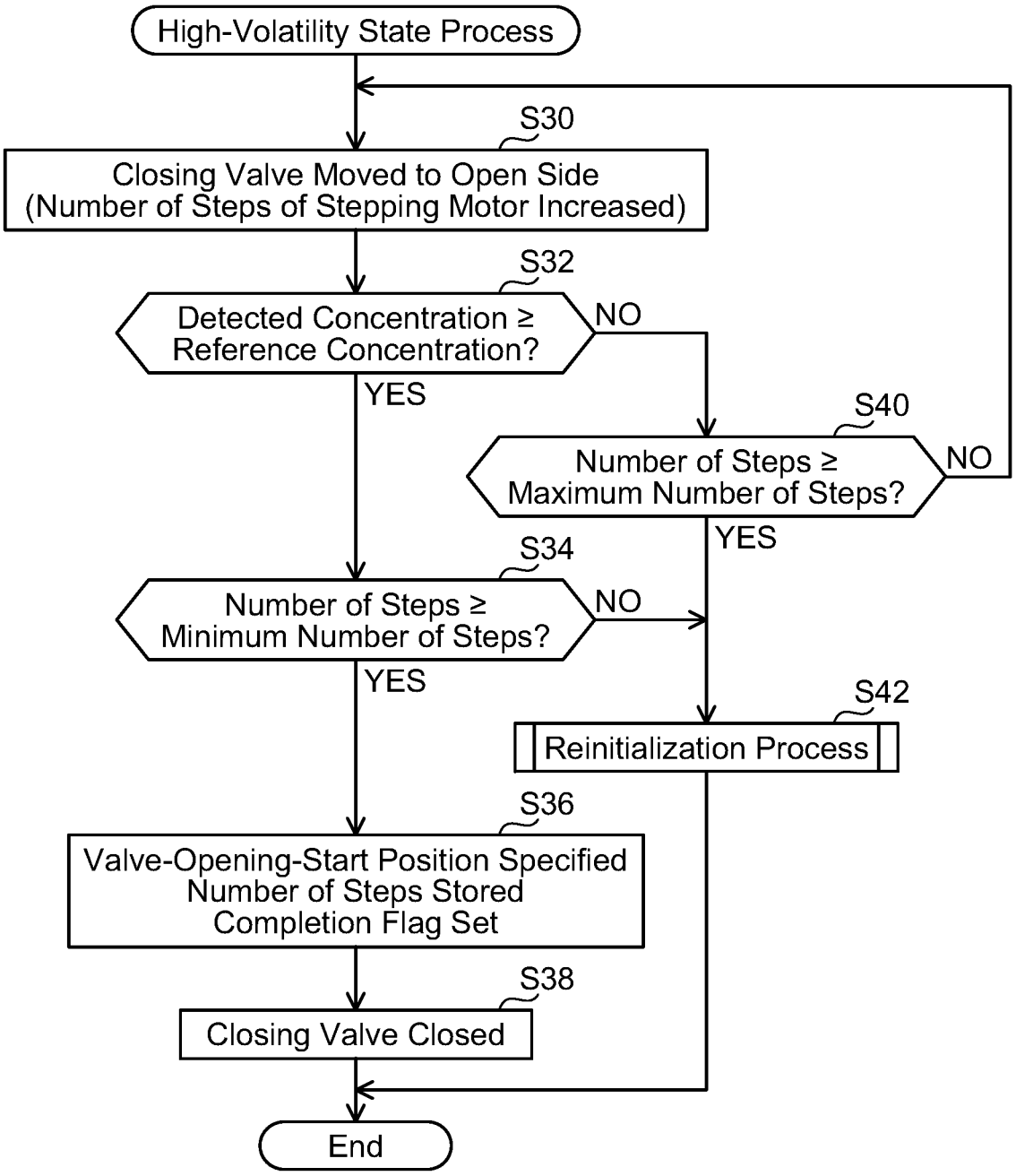
FIG. 4 is a flowchart of a high-volatility state process according to the first embodiment.

(High-Volatility State Process; FIG. 4)

Next, the high-volatility state process will be described. FIG. 4 is a flowchart of the high-volatility state process. As shown in FIG. 4, in S30 of the high-volatility state process, the controller 100 causes the closing valve 12, which is configured to open and close the vapor passage 71, to move toward the open side. More specifically, the controller 100 increases the number of steps of the stepping motor 14, which actuates the closing valve 12, by one step, for example. When the number of steps of the stepping motor 14 is increased, for example, by one step, the closing valve 12 moves toward the open side by one step, accordingly. In the course of the number of steps of the stepping motor 14 being increased, the closing valve 12 transitions from the closed state to the opened state at a certain point. That is, the closing valve 12 reaches a valve-opening-start position.

When the closing valve 12 transitions from the closed state to the opened state as a result of the closing valve 12 moving toward the open side in S30, the evaporated fuel in the vapor passage 71 flows through the closing valve 12 to the downstream portion of the vapor passage 71. Thereby, the concentration of the evaporated fuel in the vapor passage 71 downstream of the closing valve 12 increases. As a result, the detected concentration by the concentration sensor 16 on the vapor passage 71 increases. On the other hand, when the closing valve 12 is still in the closed state despite the closing valve 12 having moved toward the open side, the detected concentration by the concentration sensor 16 does not increase.

In S32, the controller 100 determines whether the detected concentration by the concentration sensor 16 is no less than a predetermined reference concentration based on the information obtained from the concentration sensor 16. That is, the controller 100 determines whether the concentration of the evaporated fuel in the vapor passage 71 downstream of the closing valve 12 is no less than the reference concentration. If the detected concentration by the concentration sensor 16 is equal to or greater than the reference concentration, the controller 100 determines YES in S32 and proceeds to S34. If not (if the detected concentration is less than the reference concentration), the controller 100 determines NO and proceeds to S40. The reference concentration used in S32 is a concentration by which the transition of the closing valve 12 from the closed state to the opened state can be recognized.

In S34 following YES in S32, the controller 100 determines whether the present number of steps of the stepping motor 14 is no less than a predetermined minimum number of steps. More specifically, the controller 100 determines whether the number of steps of the stepping motor 14 from the initial value after the initialization of the stepping motor 14 to the present number is no less than the minimum number of steps (e.g., four steps). If the present number of steps is equal to or greater than the minimum number of steps, the controller 100 determines YES in S34 and proceeds to S36. If not, the controller 100 determines NO and proceeds to S42. In S42, the controller 100 executes a reinitialization process to be described later.

In S36 following YES in S34, the controller 100 specifies the valve-opening-start position of the closing valve 12 based on the present number of steps of the stepping motor 14. More specifically, the controller 100 specifies the present position of the closing valve 12 in accordance with the present number of steps of the stepping motor 14 and specifies that position as the valve-opening-start position. The valve-opening-start position of the closing valve 12 is a position at which the closing valve 12 transitions from the closed state to the opened state. YES in S32 means that the detected concentration by the concentration sensor 16 has changed from less than the reference concentration to equal to or greater than the reference concentration as a result of the transition of the closing valve 12 from the closed state to the opened state in S30. The controller 100 specifies the position of the closing valve 12 at such timing as the valve-opening-start position.

In S36, the controller 100 also stores the present number of steps of the stepping motor 14 in the memory 102. In a variant, the controller 100 may store the number of steps immediately before the present number of steps (that is, one step before the present number of steps) in the memory 102. The controller 100 may store the number of steps immediately before the closing valve 12 transitions from the closed state to the opened state (that is, immediately before the valve-opening-start position) in the memory 102. In S36, the controller 100 also sets a completion flag indicating that the specification for the valve-opening-start position of the closing valve 12 has been completed and stores the flag in the memory 102.

In S38, the controller 100 causes the closing valve 12 to move toward the closing side to bring the closing valve 12 into the closed state. More specifically, the controller 100 decreases the number of steps of the stepping motor 14. As the number of steps of the stepping motor 14 is decreased, the closing valve 12 moves toward the closing side.

In S40 following NO in S32 (when the detected concentration by the concentration sensor 16 is less than the reference concentration), the controller 100 determines whether the present number of steps of the stepping motor 14 is no less than a predetermined maximum number of steps. More specifically, the controller 100 determines whether the number of steps of the stepping motor 14 from the initial value after the initialization of the stepping motor 14 to the present number is no less than the maximum number of steps (e.g., twenty steps). If the present number of steps is equal to or greater than the maximum number of steps, the controller 100 determines YES in S40 and proceeds to S42. If not, the controller 100 determines NO and returns to S30. In S42, the controller 100 executes the reinitialization process to be described later.

In S30, the controller 100 causes the closing valve 12 to move toward the open side again. More specifically, the controller 100 increases the number of steps of the stepping motor 14 again, for example, by one step. When the number of steps of the stepping motor 14 is increased, for example, by one step, the closing valve 12 moves toward the open side by one step, accordingly.

When the detected concentration by the concentration sensor 16 does not become equal to or greater than the reference concentration despite the closing valve 12 having moved toward the open side (NO in S32), the controller 100 repeats the process of S30 until the number of steps of the stepping motor 14 becomes equal to or greater than the maximum number of steps (NO in S40, S30). The controller 100 increases the number of steps of the stepping motor 14 at a rate of one step per 3 seconds, for example. When the number of steps of the stepping motor 14 has reached the maximum number of steps by the process of S30 having been repeated, the controller 100 determines YES in S40 and proceeds to S42. In S42, the controller 100 executes the reinitialization process to be described later. The high-volatility state process has been described.

Figure 5:
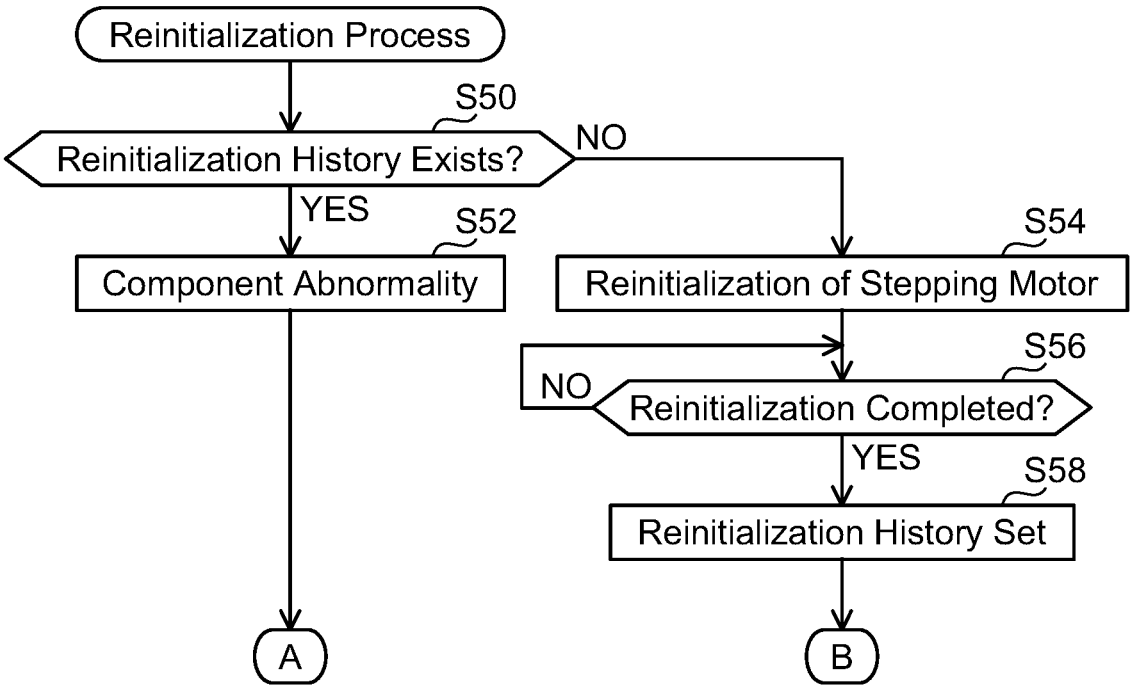
FIG. 5 is a flowchart of a reinitialization process according to the first embodiment.

(Reinitialization Process; FIG. 5)

Next, the reinitialization process will be described. FIG. 5 is a flowchart of the reinitialization process. As shown in FIG. 5, in S50 of the reinitialization process, the controller 100 determines whether a reinitialization history is present in the memory 102. The reinitialization history is information indicating that reinitialization of the stepping motor 14 has been executed before. If the reinitialization history is present in the memory 102, the controller 100 determines YES in S50 and proceeds to S52. If the reinitialization history is not present, the controller 100 determines NO and proceeds to S54.

In S52, the controller 100 determines that an abnormality is occurring in a component of the evaporated fuel processing device 1. For example, it determines that an abnormality is occurring in the closing valve 12. Alternatively, it determines that an abnormality is occurring in the pressure sensor 31 or the concentration sensor 16. When the process of S52 is completed, the controller 100 returns to "A" in the valve-opening-start position specifying process shown in FIG. 3 and terminates the valve-opening-start position specifying process.

In S54 following NO in S50, the controller 100 executes the reinitialization of the stepping motor 14. When the reinitialization of the stepping motor 14 is executed, the initial value of the stepping motor 14 is set again. Further, when the reinitialization of the stepping motor 14 is executed, the closing valve 12 is moved toward the closing side again into the closed state.

In S56, the controller 100 determines whether the reinitialization of the stepping motor 14 has been completed. If the reinitialization has been completed, the controller 100 determines YES in S56 and proceeds to S58. If not, the controller 100 determines NO and waits.

In S58, the controller 100 sets reinitialization history and stores it in the memory 102. The reinitialization history is information indicating that the reinitialization of the stepping motor 14 has been executed. When the process of S58 is completed, the controller 100 returns to "B" in the valve-opening-start position specifying process shown in FIG. 3 and executes the process of S16. The reinitialization process has been described.

Figure 6:
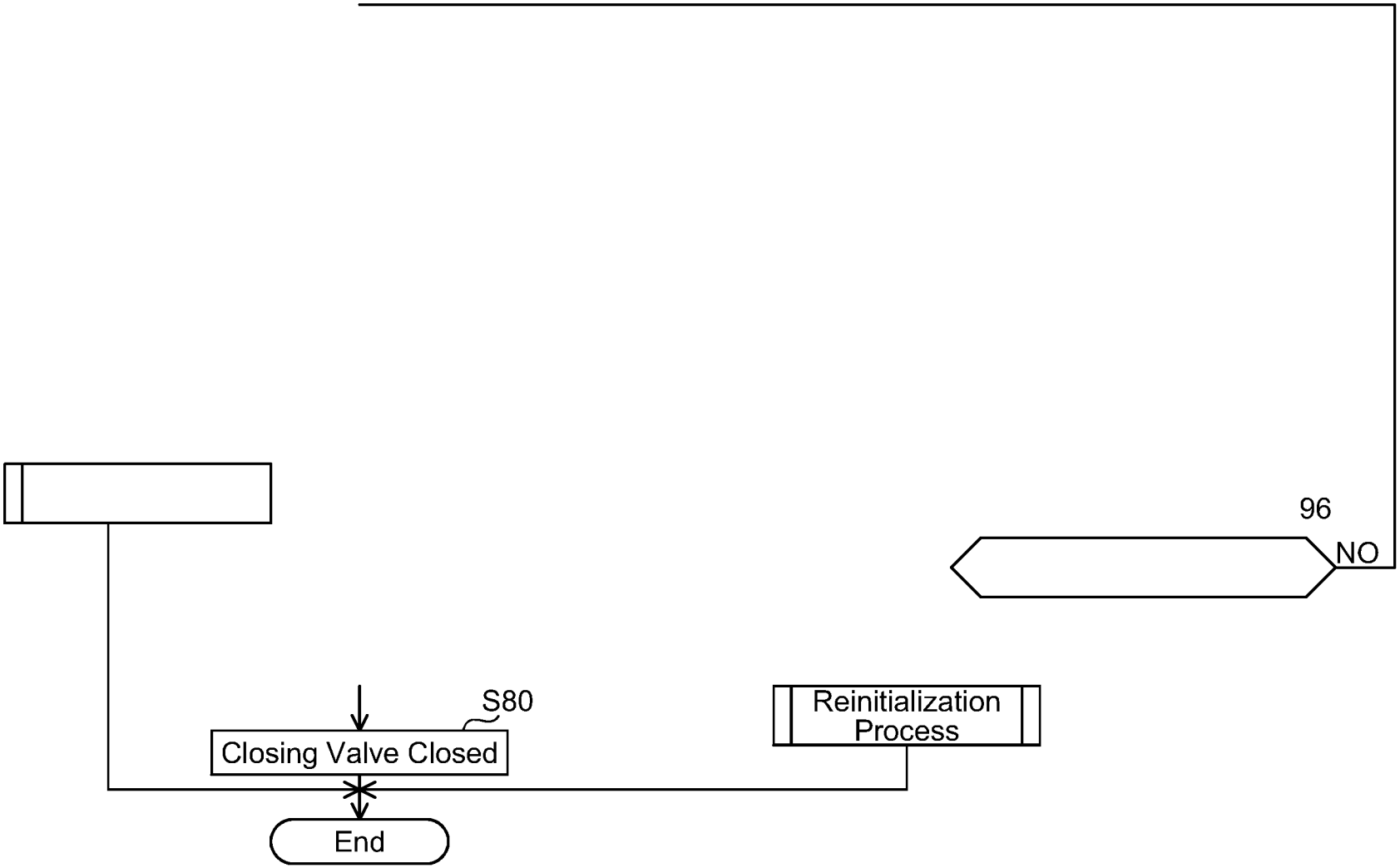
FIG. 6 is a flowchart of a low-volatility state process according to the first embodiment.

(Low-Volatility State Process; FIG. 6)

Next, the low-volatility state process following NO in S18 of the valve-opening-start position specifying process (see FIG. 3) will be described. In the description for the low-volatility state process, similar processes to those of the high-volatility state process (see FIG. 4) will be explained with corresponding reference sings and detailed description for those processes may be omitted. FIG. 6 is a flowchart of the low-volatility state process. As shown in FIG. 6, in S70 of the low-volatility state process, the controller 100 causes the closing valve 12 to move toward the open side (see S30).

In S72, the controller 100 determines whether the detected concentration by the concentration sensor 16 is no less than the reference concentration (see S32). If the detected concentration by the concentration sensor 16 is equal to or greater than the reference concentration, the controller 100 determines YES and proceeds to S74. If not, the controller 100 determines NO and proceeds to S86.

In S74, the controller 100 determines whether the present number of steps of the stepping motor 14 is no less than the minimum number of steps (see S34). If the present number of steps of the stepping motor 14 is equal to or greater than the minimum number of steps, the controller 100 determines YES and proceeds to S76. If not, the controller 100 determines NO and proceeds to S82. In S82, the controller 100 executes the reinitialization process (see S42).

In S76 following YES in S74, the controller 100 determines whether a decrease in the detected pressure by the pressure sensor 31 is no less than a predetermined reference decrease based on the information obtained from the pressure sensor 31 at the fuel tank 30. That is, the controller 100 determines whether a decrease in the pressure in the fuel tank 30 is no less than the reference decrease.

When the closing valve 12 transitions from the closed state to the opened state as a result of the closing valve 12 moving toward the open side in S70, the evaporated fuel in the vapor passage 71 flows through the closing valve 12 to the downstream portion of the vapor passage 71. When this occurs, the evaporated fuel in the fuel tank 30 flows into the vapor passage 71, and thereby the pressure in the fuel tank 30 decreases. Thus, the detected pressure by the pressure sensor 31 decreases. When the decrease in the detected pressure by the pressure sensor 31 is equal to or greater than the reference decrease, the controller 100 determines YES in S76 and proceeds to S78. For example, assuming that the reference decrease is 1 kPa, the controller 100 determines YES in S76 if the detected pressure by the pressure sensor 31 decreases by 1 kPa or more. On the other hand, if the decrease in the detected pressure by the pressure sensor 31 is less than the reference decrease, the controller 100 determines NO in S76 and proceeds to S84.

In S84, the controller 100 determines that an abnormality is occurring in the pressure sensor 31. When the closing valve 12 has transitioned from the closed state to the opened state in S70, the pressure in the fuel tank 30 decreases, and thus if the pressure sensor 31 is operating normally, the decrease in the detected pressure by the pressure sensor 31 is supposed to become equal to or greater than the reference decrease (YES in S76). If the decrease in the detected pressure by the pressure sensor 31 does not change so (NO in S76), it can be determined that an abnormality is occurring in the pressure sensor 31.

In S78, the controller 100 specifies the valve-opening-start position of the closing valve 12 based on the present number of steps of the stepping motor 14 (see S36). Further, the controller 100 stores the present number of steps of the stepping motor 14 in the memory 102 (see S36). Further, the controller 100 sets a completion flag indicating that the specification of the valve-opening-start position of the closing valve 12 has been completed and stores it in the memory 102 (see S36). In S80, the controller 100 causes the closing valve 12 to move toward the closing side to bring the closing valve 12 into the closed state (see S38).

Next, processes following NO in S72 (when the detected concentration by the concentration sensor 16 is less than the reference concentration) will be described. In S86 following NO in S72, the controller 100 determines whether the decrease in the detected pressure by the pressure sensor 31 is no less than the reference decrease based on the information obtained from the pressure sensor 31. If the decrease in the detected pressure by the pressure sensor 31 is equal to or greater than the reference decrease, the controller 100 determines YES in S86 and proceeds to S88. If not (if the decrease in the detected pressure is less than the reference decrease), the controller 100 determines NO and proceeds to S96. When the closing valve 12 is still in the closed state (the closing valve 12 does not transition to the opened state) despite the closing valve 12 having moved toward the open side in S70, the pressure in the fuel tank 30 does not decrease, and thus the detected pressure by the pressure sensor 31 does not decrease (or the decrease in the detected pressure is very small, if any). In this case, the controller 100 determines NO in S86.

In S88 following YES in S86, the controller 100 determines whether the present number of steps of the stepping motor 14 is no less than the minimum number of steps (see S34). If the present number of steps of the stepping motor 14 is equal to or greater than the minimum number of steps, the controller 100 determines YES and proceeds to S92. If not, the controller 100 determines NO and proceeds to S94. In S94, the controller 100 executes the reinitialization process (see S42).

In S92 following YES in S88, the controller 100 determines that an abnormality is occurring in the concentration sensor 16. When the closing valve 12 transitions from the closed state to the opened state in S70, the evaporated fuel in the vapor passage 71 flows through the closing valve 12 to the downstream portion of the vapor passage 71, and thus if the concentration sensor 16 is operating normally, the detected concentration by the concentration sensor 16 is supposed to become equal to or greater than the reference concentration (YES in S72). If the detected concentration does not change so (NO in S72), it can be determined that an abnormality is occurring in the concentration sensor 16.

In S78 following S92, the controller 100 specifies the valve-opening-start position of the closing valve 12 based on the present number of steps of the stepping motor 14 (see S36). Further, the controller 100 stores the present number of steps of the stepping motor 14 in the memory 102 (see S36). Further, the controller 100 sets a completion flag indicating that the specification of the valve-opening-start position of the closing valve 12 has been completed and stores it in the memory 102 (see S36). In S80, the controller 100 causes the closing valve 12 to move toward the closing side to bring the closing valve 12 into the closed state (see S38).

Next, processes following NO in S86 (when the decrease in the detected pressure by the pressure sensor 31 is less than the reference decrease) will be described. In S96 following NO in S86, the controller 100 determines whether the present number of steps of the stepping motor 14 is no less than the maximum number of steps (see S40). If the present number of steps is equal to or greater than the maximum number of steps, the controller 100 determines YES and proceeds to S94. If not, the controller 100 determines NO and returns to S70. In S94, the controller 100 executes the reinitialization process (see S42). In S70, the controller 100 causes the closing valve 12 to move toward the open side again by increasing the number of steps of the stepping motor 14 again (see S30). The low-volatility state process has been described.

As shown in FIG. 3, the valve-opening-start position specifying process is terminated after the high-volatility state process in S20 or the low-volatility state process in S22 is completed.

(Case 1)

Figure 7A:
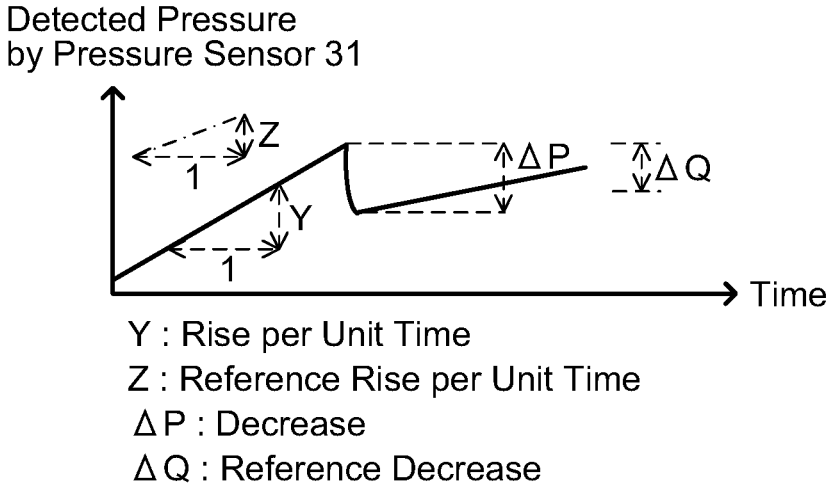
FIGS. 7A to 7D are timing charts for operation of the evaporated fuel processing device according to the first embodiment.

Next, specific cases will be described. Firstly, Case 1 will be described. FIGS. 7A to 7D are timing charts for the operation of the evaporated fuel processing device 1. In the evaporated fuel processing device 1, the controller 100 monitors the detected pressure by the pressure sensor 31 after having executed the initialization (or reinitialization) of the stepping motor 14 (see S12, YES in S14, and S16 of FIG. 3). Then, when a rise Y per unit time in the detected pressure shown in FIG. 7A is equal to or greater than a predetermined reference rise Z, the controller 100 executes the high-volatility state process (see S16, YES in S18, and S20 of FIG. 3).

Figure 7B:
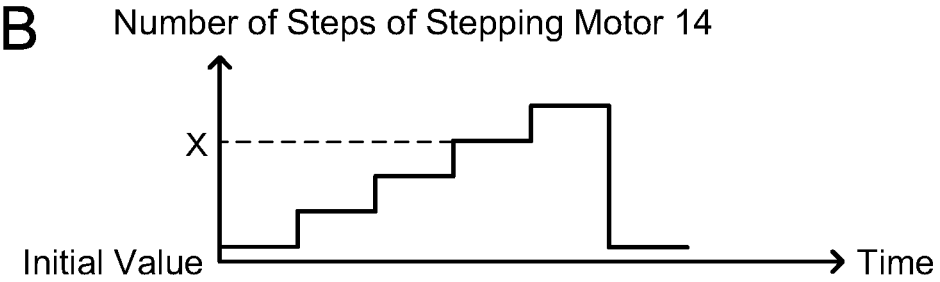

Next, as shown in FIG. 7B, the controller 100 increases the number of steps of the stepping motor 14 from the initial value (see S30 of FIG. 4 and S70 of FIG. 6). As the number of steps of the stepping motor 14 is increased, the closing valve 12 moves further toward the open side.

Figure 7C:
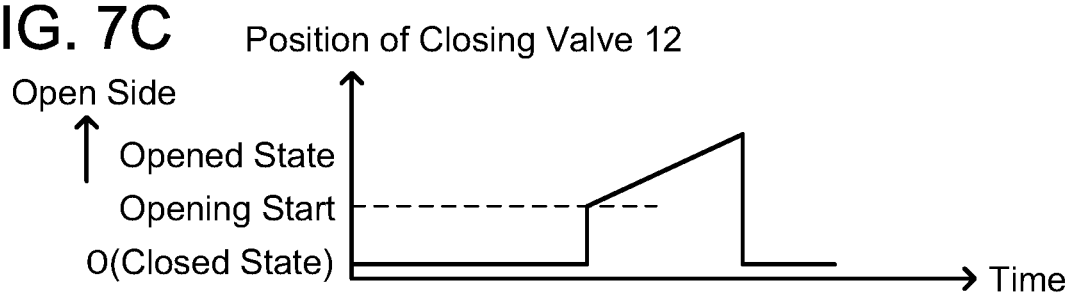
Figure 7D:
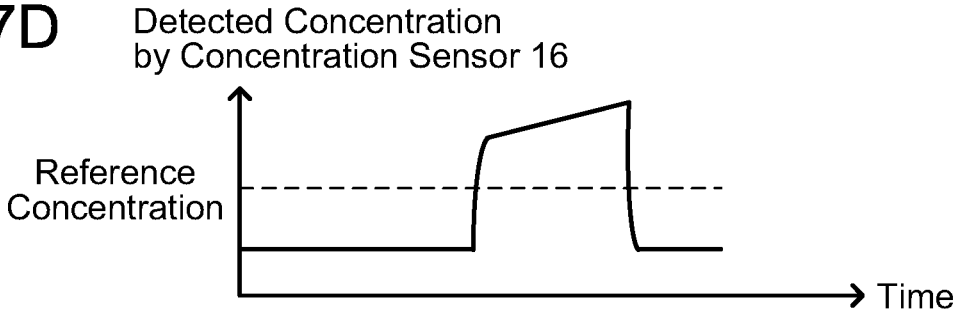

As shown in FIGS. 7B and 7C, as a result of the closing valve 12 moving toward the open side according to the increase in the number of steps of the stepping motor 14, the closing valve 12 transitions from the closed state to the opened state at a certain step X. When the closing valve 12 has transitioned from the closed state to the opened state, the detected concentration by the concentration sensor 16 increases and changes from less than the reference concentration to equal to or greater than the reference concentration as shown in FIG. 7D (see YES in S32 of FIG. 4).

When the detected concentration by the concentration sensor 16 changes from less than the reference concentration to equal to or greater than the reference concentration in the high-volatility state process, the controller 100 specifies the position of the closing valve 12 at this timing as the valve-opening-start position. The controller 100 specifies the valve-opening-start position of the closing valve 12 based on the number of steps of the stepping motor 14. The controller 100 stores the number of steps of the stepping motor 14 in the memory 102 (see S36, S38 of FIG. 4). After specifying the valve-opening-start position of the closing valve 12, the controller 100 may control the opening degree of the closing valve 12 based on the specified valve-opening-start position. The opening degree of the closing valve 12 is determined by the number of steps of the stepping motor 14 from the valve-opening-start position of the closing valve 12.

(Case 2)

Next, Case 2 will be described. When the rise Y per unit time in the detected pressure by the pressure sensor 31 shown in FIG. 7A is less than the predetermined reference rise Z, the controller 100 executes the low-volatility state process (see NO in S18, S22 of FIG. 3).

As shown in FIGS. 7B and 7C, as a result of the closing valve 12 moving toward the open side according to the increase in the number of steps of the stepping motor 14, the closing valve 12 transitions from the closed state to the opened state at the certain step X. When the closing valve 12 has transitioned from the closed state to the opened state, the detected concentration by the concentration sensor 16 increases and changes from less than the reference concentration to equal to or greater than the reference concentration as shown in FIG. 7D (see YES in S72 of FIG. 6). Further, as shown in FIG. 7A, the detected pressure by the pressure sensor 31 decreases and a decrease ΔP in the detected pressure becomes equal to or greater than a reference decrease ΔQ (see YES in S76 of FIG. 6).

When the detected concentration by the concentration sensor 16 changes from less than the reference concentration to equal to or greater than the reference concentration in the low-volatility state process, the controller 100 specifies the position of the closing valve 12 at this timing as the valve-opening-start position. The controller 100 specifies the valve-opening-start position of the closing valve 12 based on the number of steps of the stepping motor 14. The controller 100 stores the number of steps of the stepping motor 14 in the memory 102 (see S78, S80 of FIG. 6).

In the low-volatility state process, the controller 100 may specify the valve-opening-start position of the closing valve 12 based on the detected pressure by the pressure sensor 31. When the decrease in the detected pressure by the pressure sensor 31 changes from less than the reference decrease to equal to or greater than the reference decrease, the controller 100 may specify the position of the closing valve 12 at this timing as the valve-opening-start position.

(Case 3)

Next, Case 3 will be described. When the decrease ΔP in the detected pressure by the pressure sensor 31 shown in FIG. 7A is less than the reference decrease ΔQ despite the detected concentration by the concentration sensor 16 shown in FIG. 7D having become equal to or greater than the reference concentration in the low-volatility state process, the controller 100 determines that an abnormality is occurring in the pressure sensor 31 (see YES in S72, NO in S76, S84 of FIG. 6).

(Case 4)

Next, Case 4 will be described. In the low-volatility state process, when the detected concentration by the concentration sensor 16 shown in FIG. 7D is less than the reference concentration despite the decrease ΔP in the detected pressure by the pressure sensor 31 shown in FIG. 7A having become equal to or greater than the reference decrease ΔQ, the controller 100 determines that an abnormality is occurring in the concentration sensor 16 (see NO in S72, YES in S86, S92 of FIG. 6).

In this case, the controller 100 specifies the valve-opening-start position of the closing valve 12 based on the detected pressure by the pressure sensor 31. When the decrease in the detected pressure by the pressure sensor 31 changes from less than the reference decrease to equal to or greater than the reference decrease, the controller 100 specifies the position of the closing valve 12 at this timing as the valve-opening-start position (NO in S72, YES in S86, S78 of FIG. 6).

(Case 5)

Next, Case 5 will be described. When the detected concentration by the concentration sensor 16 is less than the reference concentration despite the number of steps of the stepping motor 14 having been increased to the maximum number of steps in the high-volatility state process, the controller 100 executes the reinitialization process (see S30, NO in S32, YES in S40, S42 of FIG. 4, and FIG. 5).

When the detected concentration by the concentration sensor 16 is less than the reference concentration and the decrease in the detected pressure by the pressure sensor 31 is less than the reference decrease despite the number of steps of the stepping motor 14 having been increased to the maximum number of steps in the low-volatility state process, the controller 100 executes the reinitialization process (see S70, NO in S72, NO in S86, YES in S96, S94 of FIG. 6, and FIG. 5).

When there is a reinitialization history, the controller 100 determines that an abnormality is occurring in a component of the evaporated fuel processing device 1 and terminates the valve-opening-start position specifying process (YES in S50, S52 of FIG. 5, and FIG. 3).

The evaporated fuel processing device 1 according to the first embodiment has been described. As is apparent from the foregoing description, the evaporated fuel processing device 1 includes the concentration sensor 16 configured to detect the concentration of the evaporated fuel in the vapor passage 71 downstream of the closing valve 12. When the closing valve 12 moves toward the open side in the closed state, the controller 100 specifies the valve-opening-start position at which the closing valve 12 transitions from the closed state to the opened state based on the detected concentration by the concentration sensor 16 (see S30, YES in S32, S36 of FIG. 4, and S70, YES in S72, S78 of FIG. 6).

In the above configuration, when the closing valve 12 reaches the valve-opening-start position at which it transitions from the closed state to the opened state, the evaporated fuel in the vapor passage 71 flows through the closing valve 12 to a portion of the vapor passage 71 downstream of the closing valve 12. Since the detected concentration by the concentration sensor 16 thereby changes, the valve-opening-start position of the closing valve 12 can be specified based on the detected concentration. With this configuration, the valve-opening-start position of the closing valve 12 can be specified without being affected by the pressure in the fuel tank 30, and thus the valve-opening-start position can be accurately specified. For example, in the high volatility state in which the evaporated fuel is easily generated from the fuel in the fuel tank 30, the generation rate of the evaporated fuel is relatively high, and thus the rise rate of the pressure in the fuel tank 30 is relatively high. Therefore, the pressure in the fuel tank 30 could rise even when the closing valve 12 has reached the valve-opening-start position. Since conventional configurations specify the valve-opening-start position based on the pressure in the fuel tank 30, it is difficult to specify the valve-opening-start position of the closing valve 12 in the high volatility state. Contrary to this, the above configuration specifies the valve-opening-start position of the closing valve 12 based on the detected concentration by the concentration sensor 16, and thus it can accurately specify the valve-opening-start position of the closing valve 12 without being affected by the pressure in the fuel tank 30.

In the evaporated fuel processing device 1 as above, the controller 100 specifies, as the valve-opening-start position, the position of the closing valve 12 when the detected concentration by the concentration sensor 16 becomes equal to or greater than the predetermined reference concentration. With this configuration, the valve-opening-start position can be accurately specified by specifying the valve-opening-start position of the closing valve 12 based on the reference concentration.

The evaporated fuel processing device 1 further includes the pressure sensor 31 configured to detect the pressure in the fuel tank 30. The controller 100 specifies the valve-opening-start position of the closing valve 12 based on the detected concentration by the concentration sensor 16 when the pressure in the fuel tank 30 is in a predetermined state (see YES in S18, S20 of FIG. 3, S30, YES in S32, S36 of FIG. 4).

The configuration that specifies the valve-opening-start position of the closing valve 12 based on the detected concentration by the concentration sensor 16 is especially effective when used depending on the state of the pressure in the fuel tank 30. For example, using the above configuration in the high volatility state in which the rise rate of the pressure in the fuel tank 30 is high enables the valve-opening-start position of the closing valve 12 to be accurately specified without being affected by the pressure in the fuel tank 30 even when it is difficult to specify the valve-opening-start position of the closing valve 12 based on the pressure in the fuel tank 30. Further, the above configuration is also effective in the high-pressure state in which the pressure in the fuel tank 30 is high.

In the evaporated fuel processing device 1 as above, when the rise per unit time in the detected pressure by the pressure sensor 31 is equal to or greater than the predetermined reference rise, the controller 100 specifies the valve-opening-start position of the closing valve 12 based on the detected concentration by the concentration sensor 16 (see YES in S18, S20 of FIG. 3, S30, YES in S32, S36 of FIG. 4).

The rise per unit time in the detected pressure by the pressure sensor 31 being equal to or greater than the reference rise means the high volatility state in which the evaporated fuel is easily generated from the fuel in the fuel tank 30. With the above configuration, even in the high volatility state in which it is difficult to specify the valve-opening-start position of the closing valve 12 based on the pressure in the fuel tank 30, the valve-opening-start position can be accurately specified by specifying the valve-opening-start position of the closing valve 12 based on the detected concentration by the concentration sensor 16. Further, in the high volatility state, the evaporated fuel generated from the fuel in the fuel tank 30 easily flows into the vapor passage 71. Thus, when the closing valve 12 has reached the valve-opening-start position, the detected concentration by the concentration sensor 16 tends to easily increase. As such, the configuration that specifies the valve-opening-start position of the closing valve 12 based on the detected concentration by the concentration sensor 16 is especially effective in the high volatility state.

When the rise per unit time in the detected pressure by the pressure sensor 31 is less than the predetermined reference rise, the controller 100 specifies the valve-opening-start position of the closing valve 12 based on the detected pressure by the pressure sensor 31 (see NO in S18, S22 of FIG. 3, S70, YES in S86, S78 of FIG. 6).

The rise per unit time in the detected pressure by the pressure sensor 31 being less than the reference rise does not mean the high volatility state. In this case, the influence of the pressure in the fuel tank 30 is small, and thus the valve-opening-start position of the closing valve 12 may be specified based on the detected pressure by the pressure sensor 31. With this configuration, the sensor used to specify the valve-opening-start position of the closing valve 12 can be switched between the concentration sensor 16 and the pressure sensor 31 depending on the state of the pressure in the fuel tank 30.

The controller 100 specifies, as the valve-opening-start position of the closing valve 12, the position of the closing valve 12 when the decrease in the detected pressure by the pressure sensor 31 becomes equal to or greater than the reference decrease. With this configuration, the valve-opening-start position can be accurately specified by specifying the valve-opening-start position of the closing valve 12 based on the reference decrease.

In the evaporated fuel processing device 1 as above, when the detected concentration of the concentration sensor 16 does not become equal to or greater than the reference concentration in specifying the valve-opening-start position of the closing valve 12 based on the detected pressure of the pressure sensor 31, the controller 100 determines that the concentration sensor 16 is operating abnormally (see NO in S72, YES in S86, S92, S78 of FIG. 6).

When the controller 100 specifies the valve-opening-start position of the closing valve 12 is when the closing valve 12 transitions to the opened state, and thus if the concentration sensor 16 is operating normally, the detected concentration by the concentration sensor 16 is supposed to become equal to or greater than the reference concentration accordingly. As such, when the detected concentration by the concentration sensor 16 does not become equal to or greater than the reference concentration, it can be determined that some sort of abnormality is occurring in the concentration sensor 16. With the above configuration, the valve-opening-start position of the closing valve 12 can be specified based on the detected pressure by the pressure sensor 31 and further whether the concentration sensor 16 is operating normally or not can be determined.

In the evaporated fuel processing device 1 as above, when the rise per unit time in the detected pressure by the pressure sensor 31 is less than the predetermined reference rise, the controller 100 specifies the valve-opening-start position of the closing valve 12 based on the detected concentration by the concentration sensor 16, and when the decrease in the detected pressure by the pressure sensor 31 does not become equal to or greater than the reference decrease despite the controller specifying the valve-opening-start position based on the detected concentration, the controller 100 determines that the pressure sensor 31 is operating abnormally (see NO in S18, S22 of FIG. 3, YES in S72, NO in S76, S84, S78 of FIG. 6).

When the controller 100 specifies the valve-opening-start position of the closing valve 12 in the state where the rise per unit time in the detected pressure by the pressure sensor 31 is less than the reference rise, the decrease in the detected pressure by the pressure sensor 31 is supposed to become equal to or greater than the reference decrease if the pressure sensor 31 is operating normally. As such, the decrease in the detected pressure by the pressure sensor 31 not becoming equal to or greater than the reference decrease means that the decrease in the detected pressure by the pressure sensor 31 is insufficient even though the pressure in the fuel tank 30 is decreasing. Thus in this case, it can be determined that some sort of abnormality is occurring in the pressure sensor 31. With the above configuration, the valve-opening-start position of the closing valve 12 can be specified based on the detected concentration by the concentration sensor 16 and further whether the pressure sensor 31 is operating normally or not can be determined.

The controller 100 specifies the valve-opening-start position of the closing valve 12 based on the number of steps of the stepping motor 14 configured to actuate the closing valve 12 (see S36 of FIG. 4, S78 of FIG. 6). The valve-opening-start position can be more accurately specified by specifying the valve-opening-start position of the closing valve 12 based on the number of steps of the stepping motor 14.

The controller 100 specifies the valve-opening-start position of the closing valve 12 based on the number of steps of the stepping motor 14 from the state where the stepping motor 14 is at the initial value until the closing valve 12 transitions to the opened state (see S12, YES in S14 of FIG. 3, S36 of FIG. 4, S78 of FIG. 6). With this configuration, the valve-opening-start position of the closing valve 12 can be specified more accurately since the reference is clarified. In a variant, if a present value of the stepping motor 14 is known, the controller 100 may specify the valve-opening-start position of the closing valve 12 based on the number of steps of the stepping motor 14 from the state where the stepping motor 14 is at the present value until the closing valve 12 transitions to the opened state.

The controller 100 controls the opening degree of the closing valve 12 based on the specified valve-opening-start position of the closing valve 12. With this configuration, the opening degree of the closing valve 12 can be accurately controlled.

In the evaporated fuel processing device 1 as above, the concentration sensor 16 detects the concentration of the evaporated fuel in the vapor passage 71 downstream of the closing valve 12 and upstream of the canister 40. With this configuration, the concentration of the evaporated fuel is detected before the evaporated fuel is adsorbed in the canister 40, and thus the concentration of the evaporated fuel that has flowed through the closing valve 12 can be accurately detected. Therefore, the valve-opening-start position of the closing valve 12 can be accurately specified.

While an embodiment has been described above, specific aspects are not limited to the above embodiment. In the following description, elements that are identical to those described in the foregoing description will be given the same reference signs and description thereof will be omitted.

(Variants)

(1) In the above embodiment, the controller 100 specifies, as the valve-opening-start position, the position of the closing valve 12 at the timing when the detected concentration by the concentration sensor 16 changes from less than the reference concentration to equal to or greater than the reference concentration. In a variant, the controller 100 may specify, as the valve-opening-start position, the position of the closing valve 12 at a timing when a rise in the detected concentration by the concentration sensor 16 changes from less than a predetermined reference rise to equal to or greater than the reference rise. In yet another variant, the controller 100 may specify the valve-opening-start position of the closing valve 12 based on a rise per unit time in the detected concentration by the concentration sensor 16.

(2) In the above embodiment, the controller 100 is configured to execute the high-volatility state process and the low-volatility state process. In a variant, the controller 100 may be configured to execute a high-pressure state process instead of the high-volatility state process and a low-pressure state process instead of the low-volatility state process. The controller 100 may execute the high-pressure state process when the detected pressure by the pressure sensor 31 is equal to or greater than a predetermined reference pressure, while it may execute the low-pressure state process when the detected pressure by the pressure sensor 31 is less than the reference pressure. The high-pressure state process is a process similar to the high-volatility state process (see FIG. 4). The low-pressure state process is a process similar to the low-volatility state process (see FIG. 6).

(3) In a variant, the controller 100 may be configured to execute a positive-pressure state process instead of the high-volatility state process and a negative-pressure state process instead of the low-volatility state process. The controller 100 may execute the positive-pressure state process when the detected pressure by the pressure sensor 31 is a positive pressure, while it may execute the negative-pressure state process when the detected pressure of the pressure sensor 31 is a negative pressure. The positive pressure is a pressure equal to or greater than the atmospheric pressure, and the negative pressure is a pressure less than the atmospheric pressure. The positive-pressure state process is a process similar to the high-volatility state process (see FIG. 4). The negative-pressure state process is a process similar to the low-volatility state process (see FIG. 6).

In the negative-pressure state process, the controller 100 may specify the valve-opening-start position of the closing valve 12 based on the detected pressure by the pressure sensor 31 instead of specifying the valve-opening-start position of the closing valve 12 based on the detected concentration by the concentration sensor 16. In the negative-pressure state process, the controller 100 may specify, as the valve-opening-start position, the position of the closing valve 12 at a timing when the rise in the detected pressure by the pressure sensor 31 becomes equal to or greater than the predetermined reference rise.

(4) In a variant, the controller 100 may specify the valve-opening-start position of the closing valve 12 based on the detected concentration by the concentration sensor 16 when the pressure in the fuel tank 30 is equal to or greater than a detection limit pressure of the pressure sensor 31. The detection limit pressure of the pressure sensor 31 is the maximum pressure that is detectable by the pressure sensor 31. When the pressure in the fuel tank 30 is equal to or greater than the detection limit pressure of the pressure sensor 31, it is difficult to specify the valve-opening-start position of the closing valve 12 based on the detected pressure by the pressure sensor 31. Therefore, in such a case, the controller 100 specifies the valve-opening-start position of the closing valve 12 based on the detected concentration by the concentration sensor 16. With this configuration, the valve-opening-start position of the closing valve 12 can be accurately specified even when the pressure in the fuel tank 30 is excessively high. It should be noted that how the controller 100 specifies the valve-opening-start position of the closing valve 12 based on the detected concentration by the concentration sensor 16 has been described above in detail, and thus the detailed description thereof is omitted here.

On the other hand, when the pressure in the fuel tank 30 is less than the detection limit pressure of the pressure sensor 31, the controller 100 may specify the valve-opening-start position of the closing valve 12 based on the detected pressure by the pressure sensor 31. It should be noted that how the controller 100 specifies the valve-opening-start position of the closing valve 12 based on the detected pressure by the pressure sensor 31 has been described above in detail, and thus the detailed description thereof is omitted here.

Even when the pressure in the fuel tank 30 is equal to or greater than the detection limit pressure of the pressure sensor 31, the controller 100 may specify the valve-opening-start position of the closing valve 12 based on the detected pressure by the pressure sensor 31 if the pressure in the fuel tank 30 thereafter decreases to less than the detection limit pressure of the pressure sensor 31. For example, it can be assumed that the controller 100 starts the process to specify the valve-opening-start position of the closing valve 12 based on the detected concentration by the concentration sensor 16 while the pressure in the fuel tank 30 is equal to or greater than the detection limit pressure of the pressure sensor 31. In this case, the pressure in the fuel tank 30 may become less than the detection limit pressure of the pressure sensor 31 due to a temperature decrease in the fuel tank 30, for example. In such a case, even though the controller 100 has already started the process to specify the valve-opening-start position of the closing valve 12 based on the detected concentration by the concentration sensor 16, the controller 100 may terminate the ongoing process and specify the valve-opening-start position of the closing valve 12 based on the detected pressure by the pressure sensor 31.

(5) In a variant, when the pressure in the fuel tank 30 is equal to or greater than the detection limit pressure of the pressure sensor 31, the controller 100 may open the closing valve 12 to decrease the pressure in the fuel tank 30. With this configuration, the fuel tank 30 can be depressurized, and the fuel tank 30 can thereby be protected.

(6) In a variant, the evaporated fuel processing device 1 may include a temperature sensor (not shown) configured to detect the temperature in the fuel tank 30. The controller 100 may be configured to execute a high-temperature state process instead of the high-volatility state process and a low-temperature state process instead of the low-volatility state process. The controller 100 may execute the high-temperature state process when the temperature detected by the temperature sensor is equal to or greater than a predetermined reference temperature, while it may execute the low-temperature state process when the temperature detected by the temperature sensor is less than the reference temperature. The high-temperature state process is a process similar to the high-volatility state process (see FIG. 4). The low-temperature state process is a process similar to the low-volatility state process (see FIG. 6).

(7) In the above embodiment, the stepping motor 14 actuates the closing valve 12, however, in a variant, a driving mechanism different from the stepping motor 14 may actuate the closing valve 12. The driving mechanism for the closing valve 12 is not particularly limited.

(8) In the above embodiment, the valve-opening-start position specifying process is executed every time the IG switch 105 is turned on, however, other aspects may be employed. In a variant, the valve-opening-start position specifying process may not be executed when a time interval between when the IG switch 105 was turned off to when it is turned on again is short. In yet another variant, the valve-opening-start position specifying process may be executed at a frequency of once every ten times the IG switch 105 is turned on, for example.

(9) In a variant, the reinitialization history may be deleted when a predetermined period (e.g., one month) has elapsed since when the reinitialization history was set.

Second Embodiment

Figure 8:
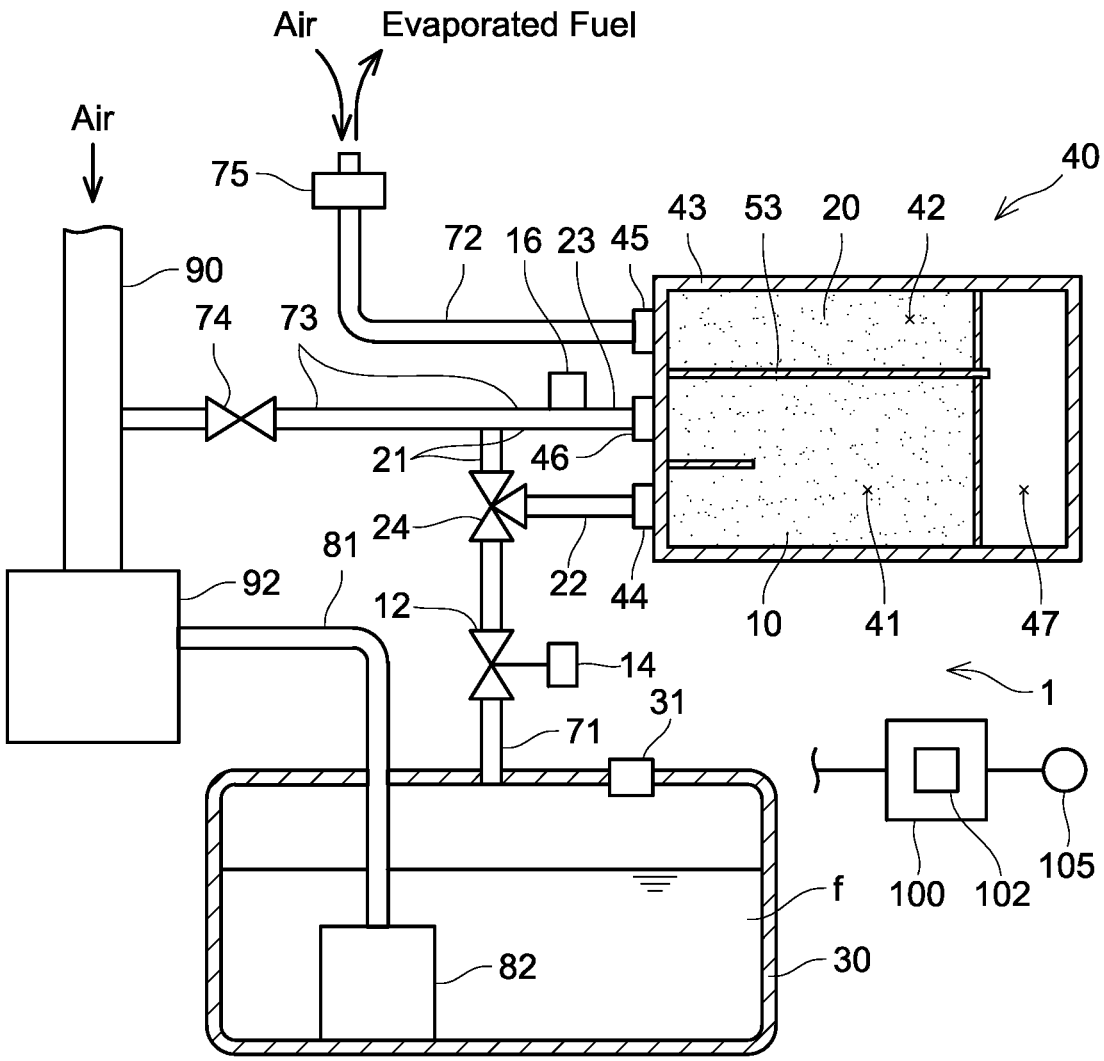
FIG. 8 schematically shows an evaporated fuel processing device according to a second embodiment.

An evaporated fuel processing device 1 according to a second embodiment will be described with reference to the drawings. FIG. 8 is a schematic diagram of the evaporated fuel processing device 1 according to the second embodiment. As shown in FIG. 8, in the evaporated fuel processing device 1 according to the second embodiment, a vapor passage 71 includes a first passage 21 and a second passage 22. Further, a switching valve 24 is disposed on the vapor passage 71. The first passage 21 and the second passage 22 are arranged in parallel to each other downstream of a closing valve 12. The vapor passage 71 branches into the first passage 21 and the second passage 22 via the switching valve 24.

The first passage 21 extends from the switching valve 24 toward a purge port 46 of a canister 40. An upstream end of the first passage 21 is connected to the switching valve 24. A downstream end of the first passage 21 is connected to the purge port 46. The gas having flowed through the first passage 21 flows into a first chamber 41 of the canister 40 through the purge port 46.

The first passage 21 includes an overlapping passage 23 that overlaps a portion of a purge passage 73 connected to the purge port 46. A portion of the first passage 21 close to the purge port 46 overlaps a portion of the purge passage 73 close to the purge port 46, and they share the overlapping passage 23. The overlapping passage 23 is connected to the purge port 46 at one end and the overlapping passage 23 branches into the first passage 21 and the purge passage 73 at another end. The overlapping passage 23 is a part of the first passage 21 and is also a part of the purge passage 73.

A concentration sensor 16 is disposed on the overlapping passage 23. The concentration sensor 16 is configured to detect the concentration of evaporated fuel contained in gas flowing through the overlapping passage 23. In the adsorbing process, the concentration sensor 16 detects the concentration of the evaporated fuel contained in the gas flowing through the first passage 21. In the desorbing process, the concentration sensor 16 detects the concentration of the evaporated fuel contained in the gas flowing through the purge passage 73. Information on the detected concentration by the concentration sensor 16 is sent to the controller 100.

The second passage 22 of the vapor passage 71 extends from the switching valve 24 toward a tank port 44 of the canister 40. An upstream end of the second passage 22 is connected to the switching valve 24. A downstream end of the second passage 22 is connected to the tank port 44. Gas having flowed through the second passage 22 flows into the first chamber 41 of the canister 40 through the tank port 44.

The switching valve 24 comprises a three-way valve. The switching valve 24 is switchable between a first passage 21 side and a second passage 22 side. When the switching valve 24 switches to the first passage 21 side, the gas flowing in the vapor passage 71 flows into the first passage 21. The gas having flowed into the first passage 21 flows through the overlapping passage 23 and is supplied to the first chamber 41 through the purge port 46 of the canister 40. The state in which the evaporated fuel flows into the canister 40 through the first passage 21 will be termed a first state.

When the switching valve 24 switches to the second passage 22 side, the gas flowing in the vapor passage 71 flows through the second passage 22 and then is supplied to the first chamber 41 through the tank port 44 of the canister 40. The state in which the evaporated fuel flows into the canister 40 through the second passage 22 will be termed a second state. The switching valve 24 is configured to switch between the first state and the second state. When the switching valve 24 switches to the second passage 22 side, gas flows out to the purge passage 73 from the first chamber 41 of the canister 40 through the purge port 46. This gas flows through the overlapping passage 23.

Figure 9:
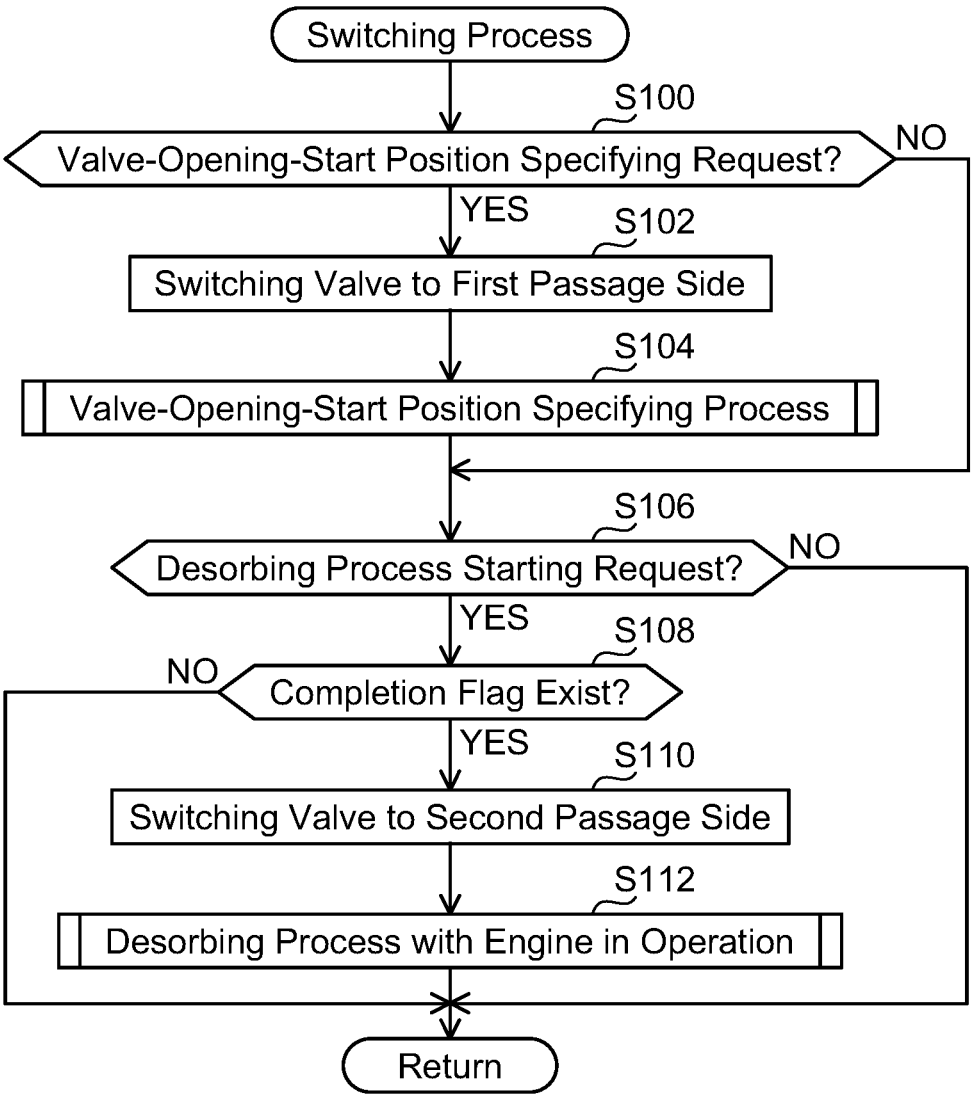
FIG. 9 is a flowchart of a switching process according to the second embodiment.

(Switching Process; FIG. 9)

Next, a switching process will be described. FIG. 9 is a flowchart of the switching process. The switching process is started when an IG switch 105 of the vehicle in which the evaporated fuel processing device 1 is mounted is turned on, for example. The IG switch 105 is turned on, for example, when the driver of the vehicle presses a start button of an engine 92.

As shown in FIG. 9, in S100 of the switching process, the controller 100 determines whether a valve-opening-start position specifying request is set. The valve-opening-start position specifying request is a request for executing the valve-opening-start position specifying process (see FIG. 3). This request is set, for example, each time the IG switch 105 of the vehicle is turned on. If the valve-opening-start position specifying request is set, the controller 100 determines YES in S100 and proceeds to S102. If not, the controller 100 determines NO, skips S102 and S104, and proceeds to S106.

In S102, the controller 100 switches the switching valve 24 on the vapor passage 71 to the first passage 21 side (first state). When the switching valve 24 is switched to the first passage 21 side, the vapor passage 71 communicates with the purge port 46 of the canister 40. When the switching valve 24 is already switched to the first passage 21 side, the controller 100 maintains that state.

In S104, the controller 100 executes the valve-opening-start position specifying process (see FIG. 3). In the valve-opening-start position specifying process, the controller 100 specifies the valve-opening-start position of the closing valve 12 based on the detected concentration by the concentration sensor 16 disposed on the overlapping passage 23 of the vapor passage 71. Since the valve-opening-start position specifying process (see FIG. 3) has been described above, the detailed description thereof is omitted here.

In S106 of the switching process, the controller 100 determines whether a desorbing process starting request is set. The desorbing process starting request is a request for executing a desorbing process. This request is set, for example, when it is determined that the canister 40 has adsorbed a predetermined reference adsorbing amount or more of the evaporated fuel. For example, the desorbing process starting request is set when a predetermined time has elapsed since the previous desorbing process was executed or when the vehicle has traveled a predetermined distance or more since the previous desorbing process was executed. The desorbing process starting request may be set when the detected pressure by the pressure sensor 31 is equal to or greater than the predetermined reference pressure. The desorbing process starting request may be termed a purge request.

If the desorbing process starting request is set, the controller 100 determines YES in S106 and proceeds to S108. If not, the controller 100 skips S108, S110, and S112 and returns to S100.

In S108, the controller 100 determines whether a completion flag is in the memory 102. The completion flag indicates that the specification of the valve-opening-start position of the closing valve 12 has been completed. When the completion flag was set in S36 of FIG. 4 or in S78 of FIG. 6, the completion flag is in the memory 102. If the completion flag is in the memory 102, the controller 100 determines YES in S108 and proceeds to S110. If not, the controller 100 by skips S110 and S112 and returns to S100.

In S110, the controller 100 switches the switching valve 24 on the vapor passage 71 to the second passage 22 side (second state). When the switching valve 24 is switched to the second passage 22 side, the vapor passage 71 communicates with the tank port 44 of the canister 40. When the switching valve 24 is already switched to the second passage 22 side, the controller 100 maintains that state. In S112, the controller 100 executes the desorbing process.

Figure 10:
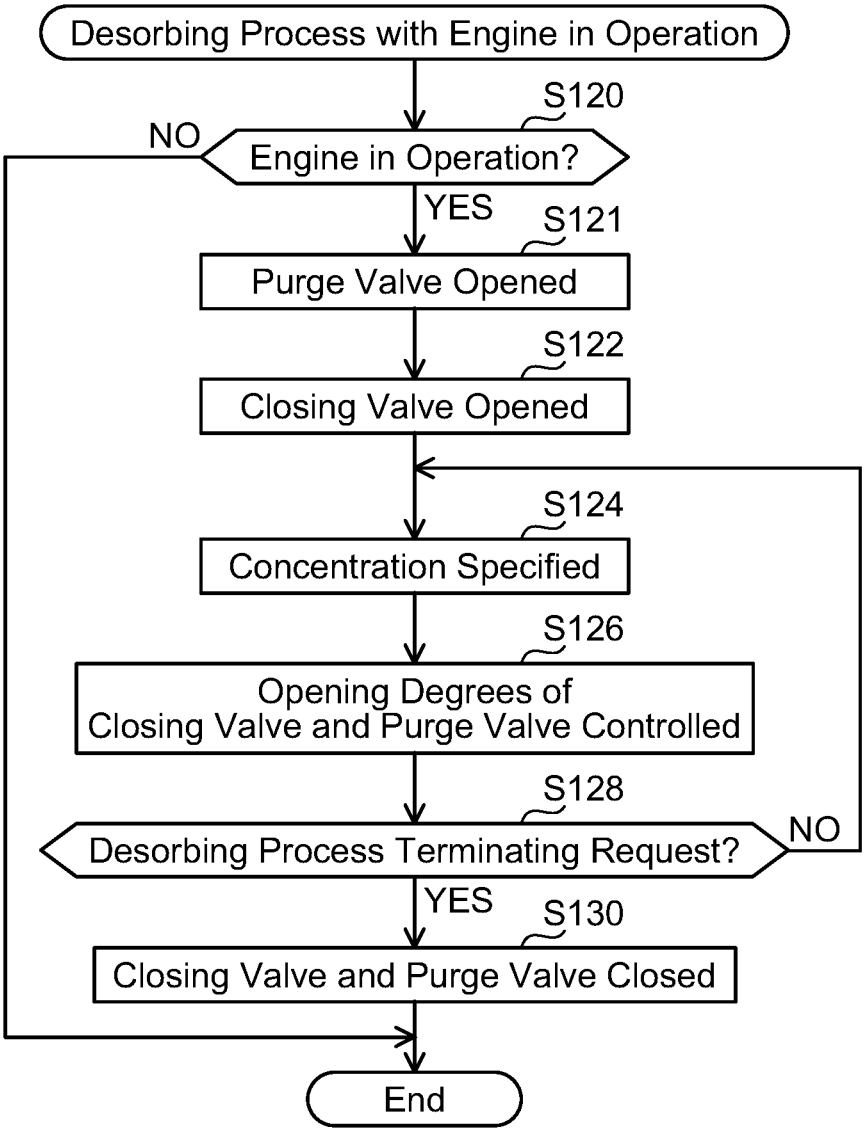
FIG. 10 is a flowchart of a desorbing process according to the second embodiment with an engine in operation.

(Desorbing Process with Engine in Operation; FIG. 10)

Next, the desorbing process with the engine in operation will be described. FIG. 10 is a flowchart of the desorbing process with the engine in operation. As shown in FIG. 10, in S120 of the desorbing process with the engine in operation, the controller 100 determines whether the engine 92 of the vehicle is in operation. If the engine 92 is in operation, the controller 100 determines YES in S120 and proceeds to S121. If not, the controller 100 determines NO and terminates the process.

In S121, the controller 100 opens the purge valve 74 on the purge passage 73. The opening degree of the purge valve 74 is set to be small in S121. When the purge valve 74 transitions to the opened state, gas is allowed to flow through the purge passage 73.

In S122, the controller 100 opens the closing valve 12 on the vapor passage 71. The controller 100 opens the closing valve 12 based on the valve-opening-start position of the closing valve 12 specified in the valve-opening-start position specifying process (see S104 of FIG. 9, and FIG. 3). The opening degree of the closing valve 12 is set to be small in S122. In the desorbing process with the engine in operation, the switching valve 24 has been switched to the second passage 22 side (see S110 of FIG. 9). Thus, gas containing the evaporated fuel in the vapor passage 71 flows through the second passage 22 when the closing valve 12 transitions to the opened state. The gas having flowed through the second passage 22 flows into the first chamber 41 through the tank port 44 of the canister 40. The evaporated fuel having flowed into the first chamber 41 is adsorbed by a first adsorbent 10 in the first chamber 41.

When the engine 92 of the vehicle operates with the purge valve 74 and the closing valve 12 in the opened states, a desorbing process in which the evaporated fuel adsorbed in the canister 40 is desorbed from the canister 40 is started. In the desorbing process, gas containing the evaporated fuel desorbed from the canister 40 flows through the purge passage 73. While the gas containing the evaporated fuel is flowing through the purge passage 73, the concentration of the evaporated fuel is detected by the concentration sensor 16 on the overlapping passage 23 of the purge passage 73.

In S124 of the desorbing process with the engine in operation, the controller 100 specifies the concentration of the evaporated fuel in the purge passage 73 based on the detected concentration by the concentration sensor 16. Since the desorbing process has been described above, the detailed description thereof is omitted here.

In S126, the controller 100 controls the opening degree of the closing valve 12 and the opening degree of the purge valve 74 based on the concentration of the evaporated fuel in the purge passage 73 specified in S124. For example, the controller 100 may increase the opening degree of the closing valve 12 to increase an amount of the evaporated fuel to be adsorbed in the canister 40. Further, for example, the controller 100 may increase the opening degree of the purge valve 74 to increase an amount of the evaporated fuel to be supplied to the engine 92. The opening degree of the closing valve 12 and the opening degree of the purge valve 74 may be set based on a prepared map. This map, for example, indicates relationships between the pressure in the fuel tank 30 and the opening degrees of the closing valve 12 and the purge valve 74, and is stored in advance in the memory 102.

In S128, the controller 100 determines whether a desorbing process terminating request is set. The desorbing process terminating request is a request for terminating the desorbing process. This request may, for example, be set when it is determined that an amount of the evaporated fuel adsorbed in the canister 40 is less than a predetermined reference adsorbing amount. For example, the desorbing process terminating request is set when a predetermined time has elapsed since the desorbing process was started or when the vehicle has traveled a predetermined distance or more since the desorbing process was started. The desorbing process terminating request may be set when the detected pressure by the pressure sensor 31 is less than the predetermined reference pressure. If the desorbing process terminating request is set, the controller 100 determines YES in S128 and proceeds to S130. If not, the controller 100 determines NO and returns to S124.

In S130, the controller 100 closes the closing valve 12 and the purge valve 74. The desorbing process with the engine in operation is thereby terminated.

The second embodiment has been described. As is apparent from the foregoing description, in the evaporated fuel processing device 1 according to the second embodiment, the concentration sensor 16 is configured to detect the concentration of the evaporated fuel in the vapor passage 71 downstream of the closing valve 12 and the concentration of the evaporated fuel in the purge passage 73 upstream of the purge valve 74. With this configuration, the concentration of the evaporated fuel before the evaporated fuel is adsorbed in the canister 40 and the concentration of the evaporated fuel after the evaporated fuel has been desorbed from the canister 40 can be detected. Either of these concentrations can be selectively detected depending on the situation.

The evaporated fuel processing device 1 includes the overlapping passage 23 where a portion of the vapor passage 71 downstream of the closing valve 12 overlaps a portion of the purge passage 73 upstream of the purge valve 74. The concentration sensor 16 is configured to detect the concentration of the evaporated fuel in the overlapping passage 23. With this configuration, two concentrations (the concentration of the evaporated fuel before the evaporated fuel is adsorbed in the canister 40 and the concentration of the evaporated fuel after the evaporated fuel has been desorbed from the canister 40) can be detected in one passage by detecting the concentrations of the evaporated fuel in the overlapping passage 23.

Figure 11:
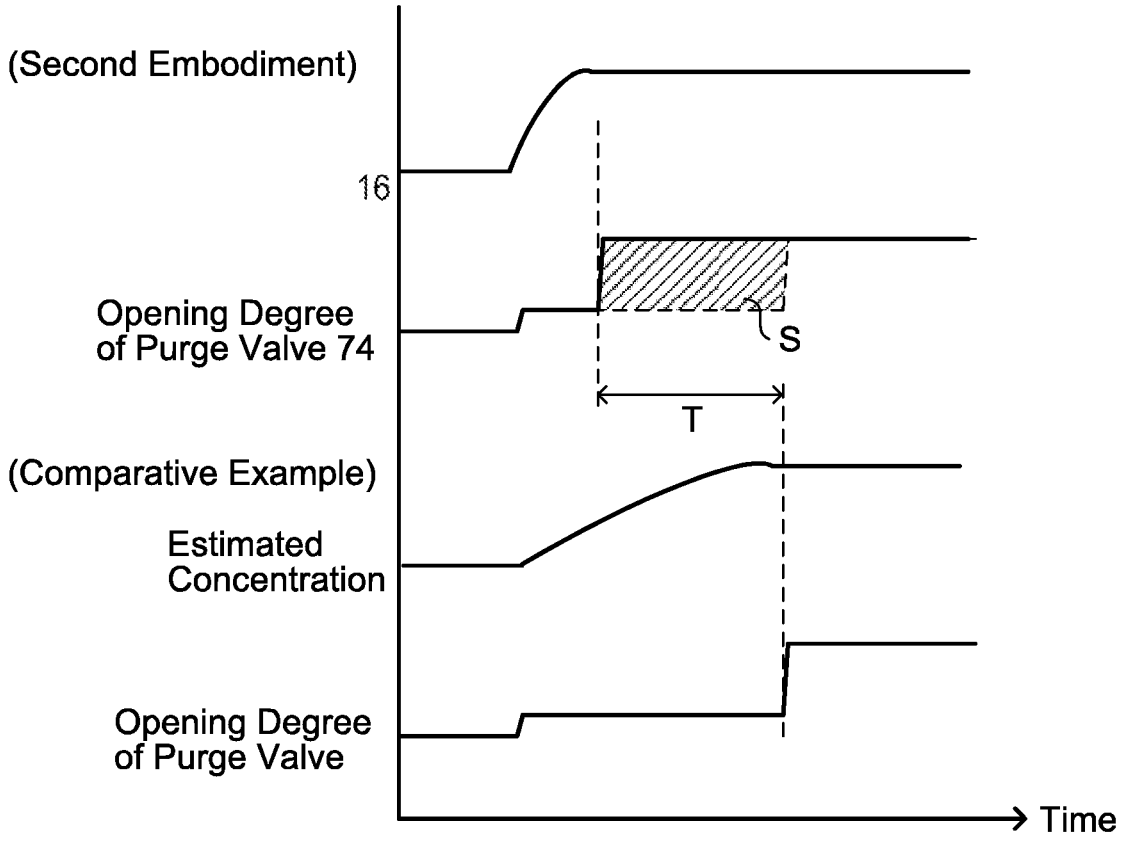
FIG. 11 is a timing chart for the second embodiment and a comparative example.

The controller 100 is configured to control the opening degree of the purge valve 74 based on the detected concentration by the concentration sensor 16 in the desorbing process. In the configuration in which the concentration of the evaporated fuel in the purge passage 73 is detected using the concentration sensor 16, the concentration of the evaporated fuel can be directly detected by the concentration sensor 16 in the desorbing process. Thus, as shown in FIG. 11, the concentration of the evaporated fuel can be detected by the concentration sensor 16 at an early stage. Thereby, the opening degree of the purge valve 74 can be controlled based on the detected concentration by the concentration sensor 16 at an early stage in the desorbing process. Thus, the opening degree of the purge valve 74 can be increased at an early stage and the purge amount can be increased at an early stage.

In a configuration according to a comparative example that does not include the concentration sensor 16 configured to detect the concentration of the evaporated fuel in the purge passage 73, the concentration of the evaporated fuel cannot be directly detected in the desorbing process. Therefore, in the comparative example, the controller has to estimate the concentration of the evaporated fuel based on an index different from the detected concentration by the concentration sensor 16 (e.g., the pressure in the fuel tank 30, the intake amount of the engine 92, etc.). As a result, in the comparative example, the concentration of the evaporated fuel cannot be specified at an early stage. Thus, the opening degree of the purge valve 74 cannot be increased at an early stage as shown in FIG. 11 and the purge amount cannot be increased at an early stage.

As described above, in the evaporated fuel processing device 1 according to the second embodiment, the opening degree of the purge valve 74 can be increased earlier by time T than the comparative example as shown in FIG. 11, and the purge amount can be increased by a region S.

In the evaporated fuel processing device 1 as above, the vapor passage 71 includes the first passage 21 and the second passage 22 that branch from the vapor passage 71 downstream of the closing valve 12 and are arranged in parallel to each other. The evaporated fuel processing device 1 includes the switching valve 24 configured to switch between the first state in which the evaporated fuel flows into the canister 40 through the first passage 21 and the second state in which the evaporated fuel flows into the canister 40 through the second passage 22. The concentration sensor 16 is configured to detect the concentration of the evaporated fuel in the first passage 21. The controller 100 switches the switching valve 24 to the second state in the desorbing process.

This configuration enables the concentration sensor 16 not to detect the concentration of the evaporated fuel that was generated from the fuel in the fuel tank 30 and has not been adsorbed yet in the canister 40 in the desorbing process. In the desorbing process, the switching valve 24 can be switched such that the concentration of the evaporated fuel desorbed from the canister 40 is detected by the concentration sensor 16. Further, the evaporated fuel having flowed through the second passage 22 can be adsorbed in the canister 40 in the desorbing process.

(Variant)

Figure 12:
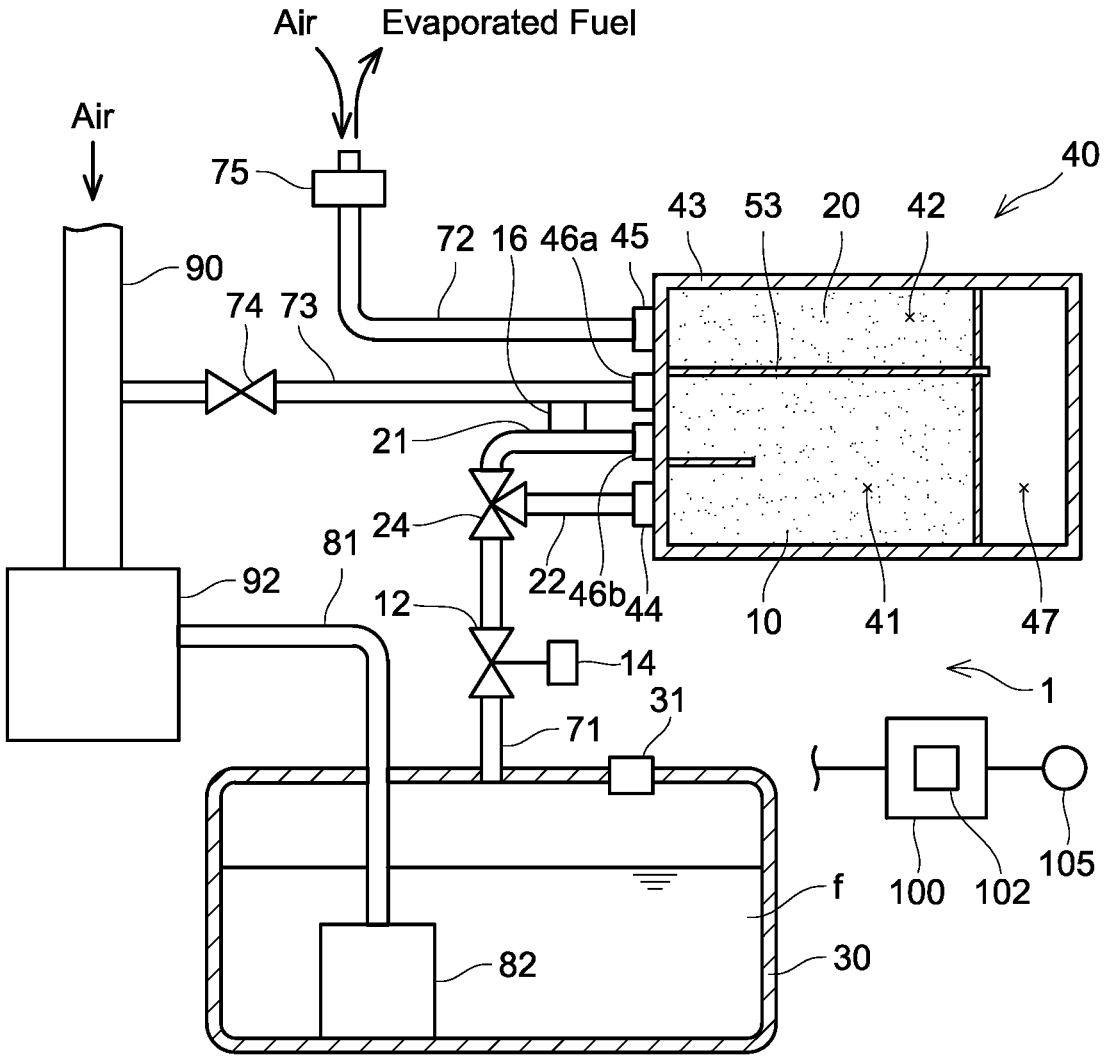
FIG. 12 schematically shows an evaporated fuel processing device according to a variant of the second embodiment.

In a variant, the overlapping passage 23 may not exist. As shown in FIG. 12, the upstream end of the purge passage 73 may be connected to a first purge port 46*a*, and a downstream end of the first passage 21 of the vapor passage 71 may be connected to a second purge port 46*b*. The evaporated fuel flows from the first chamber 41 of the canister 40 into the purge passage 73 through the first purge port 46*a*. The evaporated fuel flows into the first chamber 41 of the canister 40 from the first passage 21 through the second purge port 46*b*. The concentration sensor 16 is disposed to extend across the first passage 21 of the vapor passage 71 and the purge passage 73. The concentration sensor 16 is configured to detect the concentration of the evaporated fuel in the first passage 21 and the concentration of the evaporated fuel in the purge passage 73.

What is claimed is:

1. An evaporated fuel processing device comprising:

a fuel tank;

a vapor passage through which evaporated fuel generated from fuel in the fuel tank flows;

a closing valve configured to open and close the vapor passage;

a concentration sensor configured to detect a concentration of the evaporated fuel in the vapor passage downstream of the closing valve; and a controller, wherein when the closing valve is in an opened state, the evaporated fuel in the vapor passage flows through the closing valve, and when the closing valve is in a closed state, the evaporated fuel in the vapor passage does not flow through the closing valve, and when the closing valve moves toward an open side in the closed state, the controller specifies a valve-opening-start position of the closing valve based on the concentration detected by the concentration sensor, wherein the valve-opening-start position is a position where the closing valve transitions from the closed state to the opened state.

2. The evaporated fuel processing device according to claim 1, wherein the controller specifies, as the valve-opening-start position, a position of the closing valve when the concentration detected by the concentration sensor becomes equal to or greater than a predetermined reference concentration.

3. The evaporated fuel processing device according to claim 1, further comprising a pressure sensor configured to detect a pressure in the fuel tank, wherein when the closing valve moves toward the open side in the closed state in a state where the pressure in the fuel tank detected by the pressure sensor is in a predetermined state, the controller specifies the valve-opening-start position based on the concentration detected by the concentration sensor.

4. The evaporated fuel processing device according to claim 3, wherein when the closing valve moves toward the open side in the closed state in a state where a rise per unit time in the pressure detected by the pressure sensor is equal to or greater than a predetermined reference rise, the controller specifies the valve-opening-start position based on the concentration detected by the concentration sensor.

5. The evaporated fuel processing device according to claim 3, wherein when the closing valve moves toward the open side in the closed state in a state where a rise per unit time in the pressure detected by the pressure sensor is less than a predetermined reference rise, the controller specifies the valve-opening-start position based on the pressure detected by the pressure sensor.

6. The evaporated fuel processing device according to claim 5, wherein the controller specifies, as the valve-opening-start position, a position of the closing valve when a decrease in the pressure detected by the pressure sensor becomes equal to or greater than a predetermined reference decrease.

7. The evaporated fuel processing device according to claim 5, wherein in a case where the concentration detected by the concentration sensor does not become equal to or greater than the predetermined reference concentration when the controller specifies the valve-opening-start position based on the pressure detected by the pressure sensor, the controller determines that the concentration sensor is operating abnormally.

8. The evaporated fuel processing device according to claim 3, wherein when the closing valve moves toward the open side in the closed state in a state where the rise per unit time in the pressure detected by the pressure sensor is less than the predetermined reference rise, the controller specifies the valve-opening-start position based on the concentration detected by the concentration sensor, and when a decrease of the pressure detected by the pressure sensor does not become equal to or greater than a predetermined reference decrease even though the controller specifies the valve-opening-start position based on the concentration, the controller determines that the pressure sensor is operating abnormally.

9. The evaporated fuel processing device according to claim 1, further comprising a stepping motor configured to actuate the closing valve, wherein the controller specifies the valve-opening-start position based on a number of steps by which the stepping motor has been rotated.

10. The evaporated fuel processing device according to claim 9, wherein the controller specifies the valve-opening-start position based on the number of steps by which the stepping motor has been rotated from a state where the stepping motor is at an initial value until the closing valve transitions to the opened state.

11. The evaporated fuel processing device according to claim 1, wherein the controller controls an opening degree of the closing valve based on the specified valve-opening-start position.

12. The evaporated fuel processing device according to claim 1, further comprising a canister including an adsorbent on which the evaporated fuel having flowed through the vapor passage is adsorbed, wherein the concentration sensor detects the concentration of the evaporated fuel in the vapor passage downstream of the closing valve and upstream of the canister.

13. The evaporated fuel processing device according to claim 12, further comprising:

a purge passage through which the evaporated fuel desorbed from the canister flows; and a purge valve configured to open and close the purge passage, wherein the concentration sensor is configured to detect the concentration of the evaporated fuel in the vapor passage downstream of the closing valve and a concentration of the evaporated fuel in the purge passage upstream of the purge valve.

14. The evaporated fuel processing device according to claim 13, further comprising an overlapping passage where a portion of the vapor passage downstream of the closing valve overlaps a portion of the purge passage upstream of the purge valve, wherein the concentration sensor is configured to detect a concentration of the evaporated fuel in the overlapping passage.

15. The evaporated fuel processing device according to claim 13, wherein the evaporated fuel processing device is configured to execute an adsorbing process in which the evaporated fuel having flowed through the vapor passage is adsorbed in the canister and a desorbing process in which the evaporated fuel adsorbed in the canister is desorbed from the canister, and the controller controls an opening degree of the purge valve in the desorbing process based on the concentration detected by the concentration sensor.

16. The evaporated fuel processing device according to claim 15, wherein the vapor passage comprises a first passage and a second passage, wherein the first passage and the second passage branch from the vapor passage downstream of the closing valve and are arranged in parallel to each other, the evaporated fuel processing device further comprises a switching valve configured to switch between a first state in which the evaporated fuel flows into the canister through the first passage and a second state in which the evaporated fuel flows into the canister through the second passage, the concentration sensor is configured to detect a concentration of the evaporated fuel in the first passage, and the controller switches the switching valve to the second state in the desorbing process.

17. The evaporated fuel processing device according to claim 3, wherein when the closing valve moves toward the open side in the closed state in a state where a pressure in the fuel tank is equal to or greater than a detection limit pressure of the pressure sensor, the controller specifies the valve-opening-start position based on the concentration detected by the concentration sensor.

* * * * *